US012111133B2

(12) United States Patent
Anselmo et al.

(10) Patent No.: US 12,111,133 B2
(45) Date of Patent: Oct. 8, 2024

(54) MATERIALS FOR USE IN ARCHERY EQUIPMENT

(71) Applicant: HOYT ARCHERY, INC., Salt Lake City, UT (US)

(72) Inventors: Dan'l J Anselmo, South Jordan, UT (US); Gideon S. Jolley, Syracuse, UT (US); Zak T. Kurtzhals, Herriman, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 6 days.

(21) Appl. No.: 18/082,806

(22) Filed: Dec. 16, 2022

(65) Prior Publication Data

US 2023/0213301 A1 Jul. 6, 2023

Related U.S. Application Data

(60) Provisional application No. 63/297,051, filed on Jan. 6, 2022.

(51) Int. Cl.
*F41B 5/20* (2006.01)
*F41B 5/00* (2006.01)
*F41B 5/14* (2006.01)

(52) U.S. Cl.
CPC ..... *F41B 5/1426* (2013.01); *F41B 5/001* (2013.01)

(58) Field of Classification Search
CPC ..... F41B 5/001; F41B 5/0052; F41B 5/0078; F41B 5/10; F41B 5/1403; F41B 5/1407; F41B 5/1426
USPC ..... 124/23.1, 25, 25.6, 86, 88, 89, 90
See application file for complete search history.

(56) References Cited

U.S. PATENT DOCUMENTS 5,044,351 A * 9/1991 Pfeifer ..... F41B 5/1426 42/1.06
5,427,085 A * 6/1995 Martin ..... F41B 5/1496 124/1
5,595,168 A * 1/1997 Martin ..... F41B 5/1426 124/88
5,975,070 A * 11/1999 Sands ..... F41B 5/1426 267/136
5,996,570 A * 12/1999 Legate ..... F41B 5/1426 267/136

(Continued)

FOREIGN PATENT DOCUMENTS

EP 3736522 A1 11/2020

OTHER PUBLICATIONS

Extended European Search Report for EP Application No. 22215603.6, dated Aug. 3, 2023.

*Primary Examiner* — Alexander R Niconovich
(74) *Attorney, Agent, or Firm* — DORSEY & WHITNEY LLP

(57) ABSTRACT

An archery bow can include a riser, a first limb coupled to the riser, a second limb coupled to the riser, a string extending between the first and second limb, and Non-Newtonian material (NN material). The NN material can be incorporated into at least one of the riser, the first limb, the second limb, the string, or another component of the archery bow. The NN material can have a material property (e.g., viscosity) which varies relative to a stress or force applied to the NN material. One or more portions of NN material can additionally, or alternatively, be incorporated into a projectile (e.g., an arrow) for an archery bow, an archery target or other archery equipment.

12 Claims, 14 Drawing Sheets

(56) References Cited

U.S. PATENT DOCUMENTS 6,006,734 A * 12/1999 Sodaro ..... F41B 5/066 224/916
6,021,770 A * 2/2000 Sodaro ..... F41B 5/1426 124/89
6,039,035 A * 3/2000 McPherson ..... F41B 5/10 124/900
6,105,566 A * 8/2000 Tiedemann ..... F41B 5/066 124/25.7
6,257,219 B1 * 7/2001 McPherson ..... F41B 5/1426 124/900
6,298,842 B1 * 10/2001 Sims ..... F41B 5/1426 267/136
6,382,201 B1 * 5/2002 McPherson ..... F41B 5/0005 124/23.1
6,684,870 B1 * 2/2004 Land ..... F41B 5/1426 124/23.1
6,684,874 B2 * 2/2004 Mizek ..... F41B 5/1426 124/89
6,712,059 B2 * 3/2004 Donovan ..... F41B 5/1426 188/378
6,758,205 B2 * 7/2004 Kronfeld ..... F41B 5/1426 124/89
6,792,699 B2 * 9/2004 Long ..... A43B 1/0009 36/95
6,817,352 B1 * 11/2004 Saunders ..... F41B 5/1426 267/136
6,944,974 B2 * 9/2005 Falone ..... A43B 7/32 36/44
7,438,070 B2 * 10/2008 Mancini ..... F41B 5/1426 124/88
7,703,449 B2 * 4/2010 Wright ..... F41B 5/1426 124/89
7,721,724 B2 * 5/2010 Goade ..... F41B 5/1426 124/89
8,141,548 B2 * 3/2012 Leven ..... F41B 5/1426 267/141
8,365,712 B2 * 2/2013 Jolley ..... F41B 5/1426 124/23.1
8,448,633 B2 * 5/2013 McPherson ..... F41B 5/1407 124/90
8,656,899 B2 * 2/2014 Bednar ..... F41B 5/12 124/90
8,839,775 B2 * 9/2014 Wasilewski ..... F41B 5/1426 124/89
8,931,470 B1 * 1/2015 Khoshnood ..... F41B 5/1426 124/89
9,038,619 B1 * 5/2015 Kempf ..... F41B 5/12 124/89
9,228,791 B2 * 1/2016 Saunders ..... F41B 5/1426
9,459,068 B2 * 10/2016 Sims ..... F41B 5/1426
9,631,882 B2 * 4/2017 Grant ..... F41A 25/16
9,689,640 B2 * 6/2017 Houle ..... F16F 1/36
9,791,235 B2 * 10/2017 McPherson ..... F41B 5/1407
10,345,072 B1 * 7/2019 Webster ..... F41B 5/1411
10,555,566 B2 * 2/2020 Foster ..... A41D 19/002
10,619,967 B2 * 4/2020 Kelly ..... F41B 5/1426
11,255,629 B2 * 2/2022 D'Acquisto ..... F41B 5/1403
11,448,479 B1 * 9/2022 Liu ..... F41B 5/105
2004/0107952 A1 * 6/2004 Kronfeld ..... F41B 5/1426 124/89
2006/0102441 A1 * 5/2006 Nease ..... F16F 7/108 188/378
2009/0133683 A1 * 5/2009 Wright ..... F41B 5/1407 124/89
2011/0253009 A1 * 10/2011 Black ..... F42B 6/10 106/160.1
2014/0041645 A1 2/2014 Wasilewski et al.
2017/0030674 A1 * 2/2017 Ell ..... F41B 5/1403
2017/0168375 A1 * 6/2017 Lajoie ..... F16F 1/373
2024/0044606 A1 * 2/2024 Anselmo ..... F41B 5/0068

* cited by examiner

MATERIALS FOR USE IN ARCHERY EQUIPMENT

RELATED APPLICATION

This application claims the benefit of U.S. Provisional App. No. 63/297,051, filed on 6 Jan. 2022, the disclosure of which is incorporated, in its entirety, by this reference.

TECHNICAL FIELD

The present disclosure generally relates to archery equipment and specifically relates to incorporating Non-Newtonian materials into archery equipment.

BACKGROUND

Bowhunters and other archers use finely tuned archery equipment to improve performance. Various modifications and accessories to their equipment can improve the accuracy, efficiency, convenience, safety, and, in some cases, sound of their archery bows. Reduction of vibrations is one modification of frequent interest. For example, when a projectile, such as an arrow, is shot from the bow, the limbs, bowstring, and other connected elements of the bow will vibrate as the energy stored in the limbs and is transferred to the projectile. The vibrations can cause archer fatigue, can induce errant movements of the bow or projectile, can reduce the life of the equipment, and can cause unwanted noise, among other things. Accordingly, there is a constant need for improvements to various types of archery equipment that reduce or dampen vibrations.

SUMMARY

One aspect of the present disclosure relates to an archery bow which can include a riser, a first limb, a second limb, and a bowstring. The first and second limbs can be coupled to the riser. The bowstring can extend between the first and second limbs. At least one of the riser, the first limb, the second limb, or the bowstring can include a Non-Newtonian Material (NN material).

In some embodiments, a viscosity of the NN material can be configured to temporarily increase when a projectile is launched from the archery bow. Alternatively, the viscosity of the NN material can be configured to temporarily decrease when a projectile is launched from the archery bow. The NN material can be coupled to the riser in some embodiments. The first limb can include a first portion of the NN material and the second limb can include a second portion of the NN material. The first limb can define a length and a portion of NN material can extend along a majority of the length. The NN material can be coupled to a portion of the bowstring extending between the first limb and the second limb. The NN material can include a polymer. The archery bow can be a compound bow, a recurve bow, or a crossbow.

Another aspect of the disclosure relates to an archery bow which includes a riser, a first limb, a second limb, a string, and an accessory component. The first limb can be coupled to a first end of the riser. The second limb can be coupled to a second end of the riser. The string can extend between the first limb and the second limb. The accessory component can be coupled to at least one of the riser, the first limb, the second limb, or the string. The accessory component can include a NN material.

Yet another aspect of the disclosure relates to a projectile for an archery bow including a shaft, a nock, and a NN material. The nock can be coupled to a proximal end of the shaft.

In some embodiments, the NN material can have a viscosity configured to temporarily increase when the projectile is launched from the archery bow. The NN material can be disposed within a cavity formed by the shaft. The NN material can be a first portion of NN material and the projectile can further include a second portion of NN material disposed within the cavity. The first portion of NN material can be displaced from the second portion of NN material by a distance. The NN material can be disposed within the cavity at a distance from the proximal end of the shaft. The NN material can be disposed within the cavity at a distance from a distal end of the shaft. The shaft can include at least one of carbon fiber or aluminum alloy.

Another aspect of the disclosure relates to a target for receiving a projectile. The target can include a polymer-based foam and a NN material. In some embodiments, the polymer-based foam and the NN material define a set of layers that at least partially form the target. The set of layers can define a repeating pattern. A viscosity of the NN material can be configured to vary relative to the projectile transitioning within the target.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention can be realized by reference to the following drawings. In the appended figures, similar components or features can have the same reference label.

Figure 1:
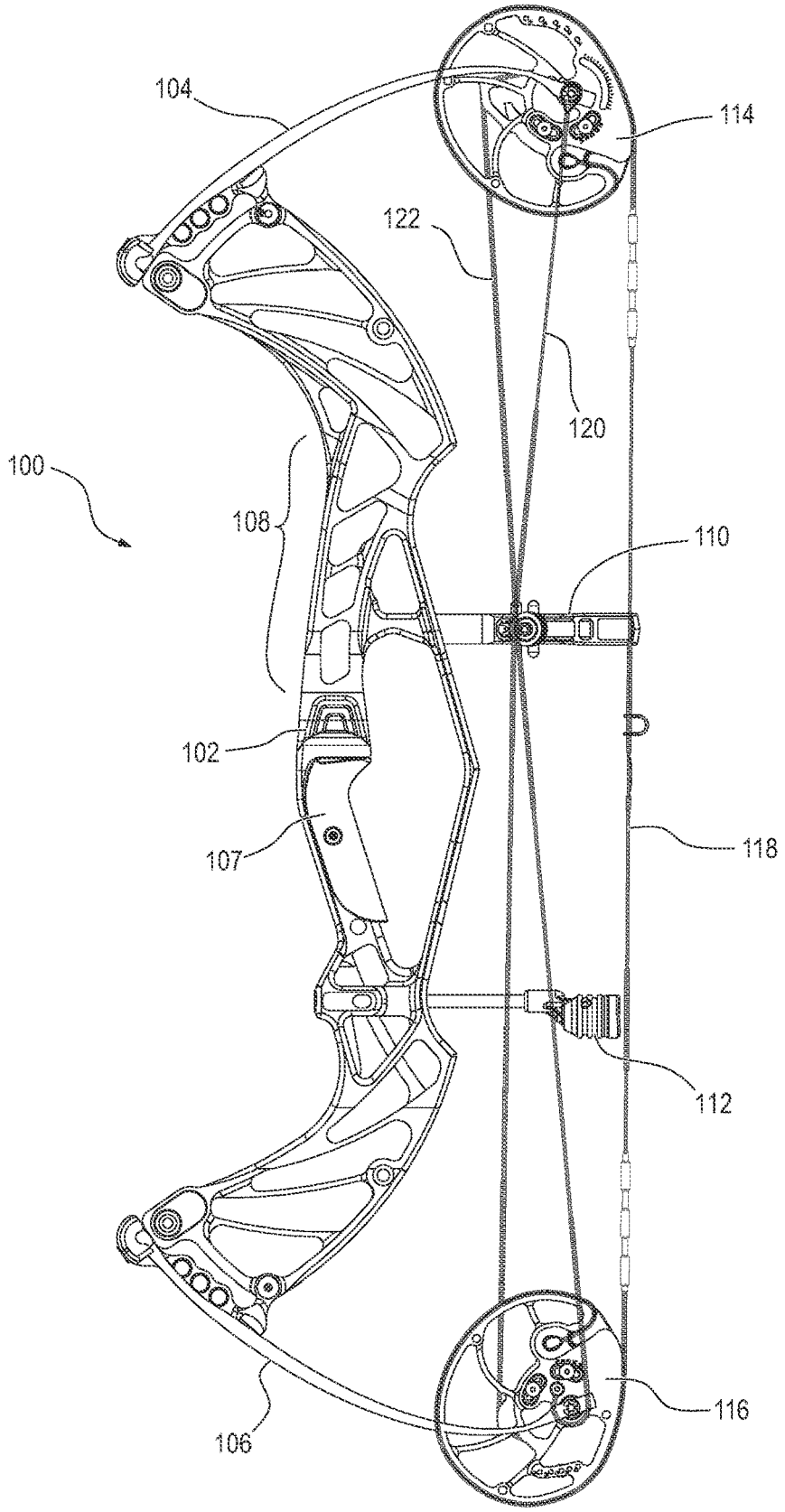
FIG. 1 is an isometric view of an archery bow.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to increased performance of archery equipment. In one aspect of the present disclosure, a Non-Newtonian Material (NN material) can be affixed, molded, adhered, or otherwise incorporated into one or more components of an archery bow, an archery accessory, or a combination thereof. Incorporation of a NN material can reduce or eliminate vibration and/or sound resultant from launching a projectile (e.g., a bolt, an arrow, etc.) or provide other benefits, such as, increased durability. A Non-Newtonian (NN) material is a material that exhibits rate-sensitive characteristics relative to stress vs. strain properties depending on the rate of loading. Newtonian material exhibit characteristics with stress vs. strain properties which are not rate-sensitive and are approximated as constant across all loading rates. Non-Newtonian (NN) materials have traditionally been fluids. In a Non-Newtonian fluid, the relation between shear stress and the shear rate is non-linear and dependent on the rate of loading while a Newtonian fluid has a constant relation between the shear stress and shear rate, defined as the viscosity. Since Non-Newtonian (NN) material can be either a fluid, gel-like, foam-like, or plastic-like polymer in application, the term viscosity is used to identify the material property which expresses the magnitude of internal friction and resistance to change in shape or movement (deformation) of the material.

The NN material can have material attributes, such as viscosity, which vary based on a quantity of rate of stress (e.g., shear force) applied to the NN material. In other words, unlike Newtonian materials, NN materials can have a viscosity that is not independent of the rate of stress applied to the material. For example, the resistance to deformation of an NN material can increase or decrease an amount that correlates with a rate of force (shear, tensile, etc.) applied (loading rate) to the NN material. The attribute, such as the viscosity of the NN material, can have a nonlinear correlation with a rate of shear stress or rate of force applied to the NN material. Examples of NN materials can include any material currently available or otherwise produced having a viscosity that is dependent upon a rate of stress or load applied to the material. A static state is the slow rate of application of force to a material and can be used to describe loading rates similar to the action of an archer drawing a bow. A dynamic state is the fast rate of application of force to an object and can be used to describe loading rates similar to the action of firing a bow A few non-limiting examples of NN fluids are cornstarch suspended in water (e.g., oobleck), wall paint, toothpaste, ketchup, and blood. Some non-limiting examples of non-fluid NN materials can include Poron® 4701-30 Polyurethane and D30® polymer. While only a limited number of specific examples of NN materials are expressly referenced, any NN materials which are currently existing or subsequently developed can be used to realize the aspects of this disclosure.

Some NN materials can be shear thickening wherein the viscosity increases as the rate of force (e.g., shear, tensile, etc.) is increased. For example, the viscosity of a shear thickening NN material can increase when the NN material undergoes a dynamic event (e.g., a projectile is launched from the archery bow). Alternatively, some NN materials are shear thinning wherein the viscosity decreases as the rate of force (e.g., shear, tensile, etc.) is increased. For example, the viscosity of a shear thinning NN material can decrease when the NN material undergoes a dynamic event (e.g., a projectile is launched from the archery bow). NN materials can be incorporated into the archery bow to alter the vibrational characteristics of the archery bow during and after a shot event (i.e., when a projectile is launched from the archery bow) relative to the state (e.g., dynamic and/or static) of the archery bow. For example, the NN material can reduce or eliminate at least one of high-frequency vibrations and low-frequency vibrations to improve the performance of the archery bow and shooting experience for the archer. A shear thickening material will resist deformation in a dynamic state. Shear thickening materials can be effective as an outer layer to protect against impact as the material will resist a localized high rate of deformation and spread it across a larger non-localized area. Shear thickening materials can also be effective at increasing the dynamic stiffness of a structure and altering the structure's natural frequency of response during a dynamic event. The NN material can act as a material which has a dynamic natural response frequency which is significantly different than the material's static natural response frequency. The difference in static and dynamic natural frequencies of the same object promotes an effective damping behavior which prevents the occurrence of resonance.

In some embodiments, a shear thinning NN material, a shear thickening NN material, or a combination thereof can be incorporated into one or more components of an archery bow to provide variable dampening which correlates to loads exerted on the one or more components. For example, the limbs, string, riser, another component of the archery bow, or a combination thereof can include NN material to reduce or eliminate vibration and/or sound resultant from launching a projectile. Additionally, or alternatively, the limbs, string, riser, another component of the archery bow, or a combination thereof can include NN material to reduce or eliminate damage resultant from an object contacting the archery bow. For example, a shear thickening NN material can be incorporated into the limbs of the archery bow to reduce or prevent limb splinters when the archery bow is dropped onto a hard surface or object (e.g., dropped from a tree stand onto a rock or log). As another example, a shear thickening NN material can be incorporated onto a string groove of a recurve limb to mitigate damage to the limb caused by the bowstring repeatedly impacting the string groove when a projectile is launched from the recurve bow.

Another aspect of the disclosure relates to incorporating a NN material on or within a projectile of an archery bow. For example, one or more portions of a NN material can be disposed within a shaft of an arrow and configured to temporarily increase or decrease in viscosity while the arrow is launched, in flight, impacting the target, or a combination thereof. In some embodiments, the NN material can impact the stiffness of an arrow, such that, the arrow acts more stiff or less stiff under a dynamic load than when in a static state. A temporarily stiffer or more rigid arrow can reduce energy loss caused by bending oscillations undertaken by the arrow while the arrow is being launched and in flight.

Another aspect of the disclosure relates to incorporating a NN material within or on an archery target to temporarily increase or decrease viscosity and alter a depth a projectile can penetrate or transition through the target. For example, a force applied by the projectile onto the target can cause the one or more portions of NN material's viscosity to increase (i.e., thicken) and thereby limit or reduce a depth the projectile can penetrate into the target. Additionally, the NN material's viscosity can be relatively lower when the projectile has come to rest in the target (i.e., a static state) such that removing the projectile from the target requires relatively less force. In other words, penetration of the projectile into the archery target can be reduced and the projectile can be more easily pulled or removed from the target by the archer.

The present description provides examples, and is not limiting of the scope, applicability, or configuration set forth in the claims. Thus, it will be understood that changes can be made in the function and arrangement of elements discussed without departing from the spirit and scope of the disclosure, and various embodiments can omit, substitute, or add other procedures or components as appropriate. For instance, features described with respect to certain embodiments can be combined in other embodiments.

Referring now to the figures in detail, FIG. 1 shows an archery bow 100 according to an embodiment of the present disclosure. The bow 100 is at a rest position (e.g., a brace position). The bow 100 can comprise a riser 102 from which one or more upper limbs 104 and one or more lower limbs 106 extend. The riser 102 can comprise a handle portion 107 (i.e., a grip), a sight window portion 108, a roller guard or cable guard 110, a string-stop damper 112, and other parts and accessories commonly known in the art.

The upper limbs 104 can be connected to an upper cam 114, and the lower limbs 106 can be connected to a lower cam 116. A bowstring 118 (i.e., draw string) can extend across the length of the bow 100 between the upper cam 114 and the lower cam 116 when the bow 100 is positioned vertically upright in a normal shooting orientation. The terminal ends of the bowstring 118 can be attached to and held wrapped against the cams 114, 116, at least in the brace position, and the limbs 104, 106 can be flexed to store energy and retain tension in the bowstring 118. A first cable 120 and a second cable 122 can also be attached to and extend between the upper cam 114 and the lower cam 116. Collectively, the first cable 120 and the second cable 122 can be referred to herein as the cables of the bow 100. The first and second cables 120, 122 can retain tension in the limbs 104, 106 and cams 114, 116 and can be controlled to adjust tension in the bowstring 118, draw length of the bowstring 118, and other tuning features of the bow 100.

The figures illustrate example archery apparatuses that can be used in conjunction with the principles and teachings of the present disclosure. Thus, while the bow 100 is a compound bow, it will be understood by those having ordinary skill in the art that the components of the archery bow, accessories, and related methods and apparatuses included in embodiments of the present disclosure can be applied to components and apparatuses in traditional bows, compound bows, recurve bows, crossbows, their accessories, and other related archery equipment. Similarly, archery equipment applying the teachings of the present disclosure does not need to implement all of the features of the present disclosure. For example, in some embodiments, the bow may not comprise a cable guard 110 or a string-stop damper 112, so features associated with those accessories can be omitted from the bow.

When shooting an arrow, the tail end of the arrow can be nocked with the bowstring 118 at a nocking point while the bow 100 is in the rest position shown in FIG. 1. The bowstring 118 can be drawn rearward to a full draw position, thereby partially unraveling the bowstring 118 from the outer grooves of the cams 114, 116. The archer can grip the handle portion 107 of the riser 102 and draw back the bowstring 118 (e.g., by using a well-known D-loop). As the limbs 104, 106 flex inward and the cables 120, 122 wind around the cams 114, 116, the cables 120, 122 can slide along or can be in rolling contact with portions of the cable guard 110, which can comprise at least one roller or other smooth support in contact with the cables 120, 122 where they contact the cable guard 110.

When the bowstring 118 is released, the potential/stored energy in the limbs 104, 106 is released, and the bowstring 118 quickly accelerates back toward the rest position (shown in FIG. 1) as it applies a shooting force to an end of the projectile (e.g., an arrow). As the limbs 104, 106 release their energy, they spread apart, and the terminal ends of the bowstring 118 wrap around the cams 114, 116, and the cables 120, 122 unwind from the cams 114, 116. A portion of the bowstring 118 can come into contact with the string-stop damper 112, which can help dampen vibrations in the bowstring 118, and the cables 120, 122 can roll or slide against the cable guard 110 as the cams 114, 116 move. Vibrations and reverberations in the bow 100 can dampen out, at least partially due to dampening provided by an NN material incorporated into one or more components of the bow 100, and bow 100 can return to the brace position shown in FIG. 1. In this process, the cams 114, 116 and at least one roller can rotate relative to the limbs 104, 106 or cable guard 110 of the bow 100.

Vibration resultant from launching the projectile can negatively affect an archer's aim and accuracy, the structure and tuning of the bow, and the lifespan of the strings and other parts of the bow 100. Vibration also contributes to the loudness of noise made by the shooting the bow 100. Accordingly, among other benefits, aspects of the present disclosure relate to vibration dampening and related methods that can be used to address challenges faced by archers and archery products manufacturers.

Figure 2:
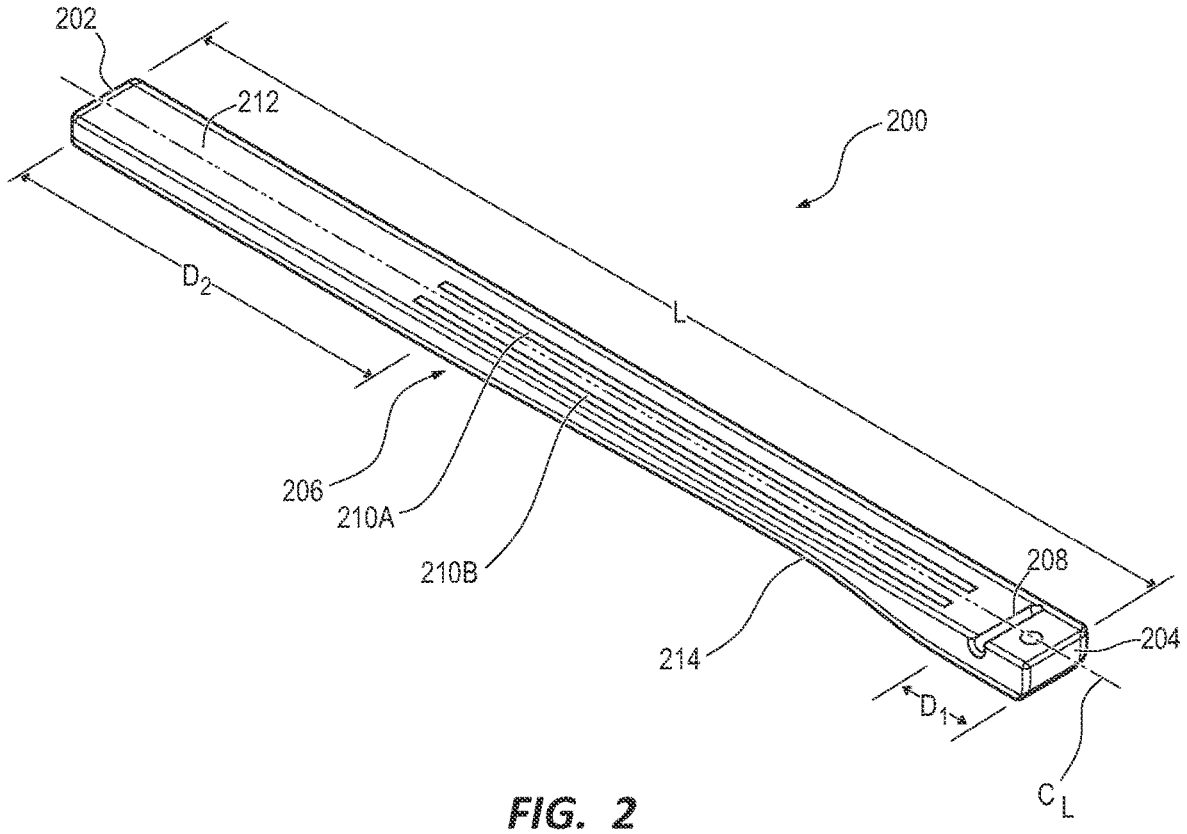
FIG. 2 is an isometric view of a limb of an archery bow, according to some embodiments.

FIGS. 2-5B show various examples of limbs for archery bows which incorporate one or more NN materials to reduce or limit vibration of an archery bow. While these examples illustrate the one or more portions of NN material at particular positions within or on the limb(s), these examples should not be considered limiting as this disclosure anticipates NN material disposed in one or more locations anywhere on or within one or more limbs. FIG. 2 is an isometric view of a limb 200 of an archery bow, according to some embodiments. In some embodiments, the limb 200 can be a singular top or singular bottom limb of an archery bow (e.g., an archery bow with a single upper limb and a single lower limb). In other embodiments, the limb 200 can be one of a pair of limbs of an archery bow, such as, the upper limbs or lower limbs of the archery bow 100 shown in FIG. 1.

In some embodiments, the limb 200 can include a proximal end 202, a distal end 204, and an intermediate portion 206 disposed between the distal and the proximal ends 204, 202. The proximal end 202 can be fastened, affixed, or otherwise coupled to a riser (e.g., riser 102), for example, by a limb pocket or other component fastened to the riser. The distal end 204 can include a through-hole 208 or other feature which enable a cam (e.g., upper or lower cam 114, 116) to be rotatably coupled to the limb 200. The limb 200 can include one or more portions of NN material 210A, 210B disposed on or within the limb 200. For example, the one or more portions of NN material 210A, 210B can be disposed between layers of other materials that form the limb 200, such as, between layers of fiberglass, carbon fiber, or another glass reinforced material.

In some embodiments, as shown in FIG. 2, the one or more portions of NN material 210A, 210B can extend along the intermediate portion 206 of the limb 200. For example, the one or more portions of NN material 210A, 210B can extend a majority of a length L between the proximal end 202 and the distal end 204. In other embodiments, the one or more portions of NN material 210A, 210B may not extend a majority of the length L between the proximal end 202 and the distal end 204.

The one or more portions of NN material 210A, 210B can be offset or spaced a distance $D_1$ from the distal end 204 of the limb 200. For example, the distance $D_1$ can be less than about 5 millimeters, between about 5 millimeters and about 20 millimeters, between about 20 millimeters and about 50 millimeters, between about 50 millimeters and about 100 millimeters, or greater than 100 millimeters. Alternatively, the one or more portions of NN material 210A, 210B can be disposed flush with or at the distal end 204 of the limb 200. Additionally, or alternatively, the one or more portions of NN material 210A, 210B can be offset or spaced a distance $D_2$ from the proximal end 202 of the limb 200. For example, the distance $D_2$ can be less than about 5 millimeters, between about 5 millimeters and about 20 millimeters, between about 20 millimeters and about 50 millimeters, between about 50 millimeters and about 100 millimeters, or greater than 100 millimeters. Alternatively, the one or more portions of NN material 210A, 210B can be disposed flush with or at the proximal end 202 of the limb 200. In some embodiments, the one or more portions of NN material 210A, 210B can be disposed nearer the distal end 204 of the limb 200 than the proximal end 202 of the limb 200. Alternatively, the one or more portions of NN material 210A, 210B can be disposed nearer the proximal end 202 of the limb 200 than the distal end 204 of the limb 200.

In some embodiments, the limb 200 can form a first surface 212 that is in tension when the limb 200 is under a load and a second surface 214 that is in compression when the limb 200 is under a load. One or more portions of NN material 210A, 210B can be disposed on one or more of the first and second surfaces 212, 214 (i.e., adhered or otherwise affixed to one or both of the first and second surfaces 212, 214). Additionally, or alternatively, one or more portions of NN material 210A, 210B can be disposed between the first and second surfaces 212, 214. For example, the limb 200 can be formed from distinct layers of material that are adhered or otherwise affixed to form the limb 200. One or more portions of the NN material can be disposed between the distinct layers of material that form the limb 200. In some embodiments, the one or more portions of NN material 210A, 210B can be disposed nearer the first surface 212 of the limb 200 than the second surface 214 of the limb 200. Alternatively, the one or more portions of NN material 210A, 210B can be disposed nearer the second surface 214 of the limb 200 than the first surface 212 of the limb 200.

As shown in FIG. 2, the one or more portions of NN material 210A, 210B can be disposed within or on the limb 200, such that, the one or more portions of NN material 210A, 210B are symmetrical about a centerline $C_L$ extending longitudinally along the center of the limb 200. The centerline $C_L$ can be an axis or a plane that extends from the proximal end 202 to the distal end 204 of the limb 200. The centerline $C_L$ is positioned between the longitudinal sides of the limb 200. Longitudinal symmetry of the one or more portions of NN material 210A, 210B about the centerline $C_L$ can be beneficial to limit or prevent the limb from twisting or torqueing along the centerline $C_L$ while under load. While the one or more portions of NN material 210A, 210B are illustrated as two distinct portions extending on either side of the centerline $C_L$ in FIG. 2, a single portion of NN material can alternatively, or additionally, be incorporated into the limb (see FIG. 3). Moreover, while the one or more portions of NN material 210A, 210B are illustrated as two distinct portions extending side by side in FIG. 2, two or more portions of NN material extending sequentially (one after the other) along the centerline $C_L$ can alternatively, or additionally, be incorporated into the limb. Alternatively, the one or more portions of NN material 210A, 210B can be purposefully non-symmetric with respect to the centerline $C_L$ so as to create a dynamic balancing offset of undesirable torque induced in the cam and/or limb due to shifting of tensions from cables (offset relative to a central point between the limbs) to the bowstring (centered between the limbs).

While the limb 200 is under load, a viscosity of the one or more portions of NN material 210A, 210B can vary, such that the NN material better absorbs vibrations resultant launching a projectile from the bow. In other words, the one or more portions of NN material 210A, 210B can have a first viscosity prior to the projectile being launched from the bow and have a second viscosity immediately after the projectile is launched from the bow. The variance between the first viscosity and second viscosity can be directly related to loading rates of forces or loading rates of stresses applied to the one or more portions of NN material 210A, 210B resultant from vibrations generated by launching the projectile. In some embodiments, the first viscosity can be greater than the second viscosity. Alternatively, in some embodiments, the first viscosity can be less than the second viscosity. This variance in viscosity of the one or more portions of NN material 210A, 210B can better dampen vibrations to reduce or eliminate the vibration and/or sound resultant from launching a projectile from the bow.

Figure 3:
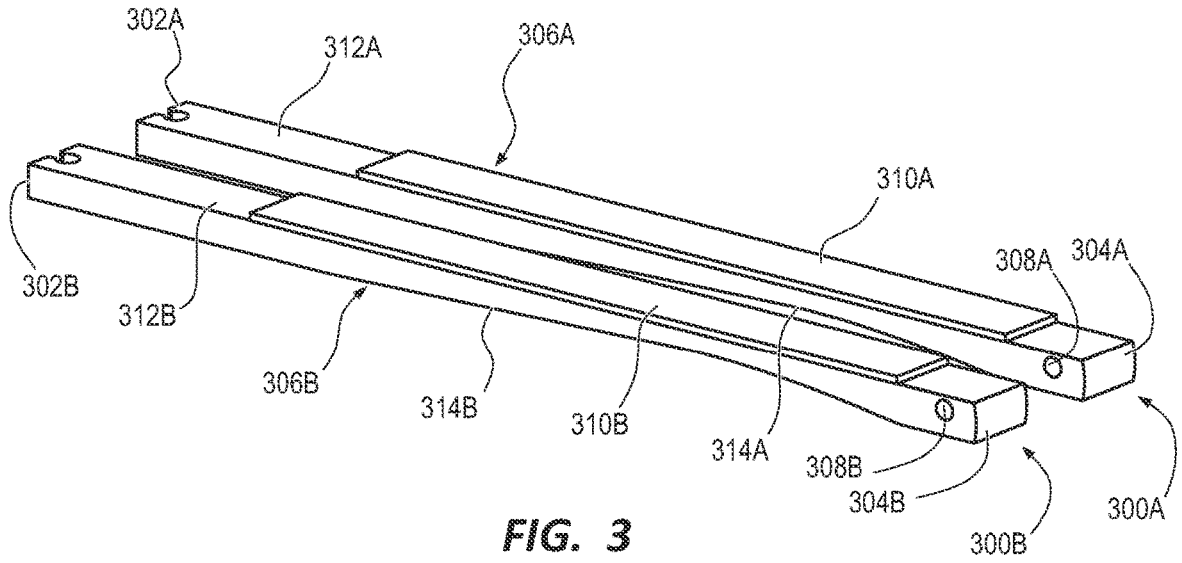
FIG. 3 is an isometric view of a pair of limbs of an archery bow, according to some embodiments.

FIG. 3 is an isometric view of a pair of limbs 300A, 300B of an archery bow, according to some embodiments. Each limb of the pair of limbs 300A, 300B can be similar to, and can include some or all of, the features of the limb 200. For example, each limb of the pair of limbs 300A, 300B can include a proximal end 302A, 302B, a distal end 304A, 304B, and an intermediate portion 306A, 306B disposed between the distal end 302A, 302B and the proximal end 304A, 304B. The respective distal ends 304A, 304B can include respective through-holes 308A, 308B or other features which enable a cam (e.g., upper or lower cam 114, 116) to be rotatably coupled between the limbs 300A, 300B. Each of the limbs 300A, 300B can include a portion of NN material 310A, 310B. For example, as shown in FIG. 3, the respective portions of NN material 310A, 310B can be adhered, coupled, or otherwise affixed to a first surface 312A, 312B of the limb (e.g., a surface under tension while the limb is loaded). Additionally, or alternatively, the respective portions of NN material 310A, 310B can be adhered, coupled, or otherwise affixed to a second surface 314A, 314B of the limb (e.g., a surface in compression while the limb is loaded).

While the portion of NN material 310A is illustrated at a particular location on the intermediate portion 306A of the limb 300A with respect to the proximal and distal ends 302A, 304A, the portion of NN material 310A can be disposed at any distance (e.g., distances $D_1$, $D_2$ shown in FIG. 2) with respect to the proximal and distal ends 302A, 304A. Similarly, the portion of NN material 310B can be disposed at any distance (e.g., distances $D_1$, $D_2$ shown in FIG. 2) with respect to the proximal and distal ends 302B, 304B of limb 300B. In some embodiments, the portions of NN material 310A, 310B can be disposed within or on the respective limbs 300A, 300B, such that, the one or more portions of NN material 310A, 310B are symmetrical about a centerline (see centerline $C_L$ of FIG. 2) extending longitudinally along the center of each of the limbs 300A, 300B. In some embodiments, the portion of NN material 310A can be identically shaped, sized, and positioned on limb 300A as the portion of NN material 310B disposed on limb 300B, such that, the portions of NN material 310A, 310B are symmetrical or mirrored when the limbs 300A, 300B are coupled to an archery bow.

While each of the portions of NN material 310A, 310B are shown as singular or unitary pieces of material in FIG. 3, one or both of the portions of NN material 310A, 310B can be formed of multiple distinct pieces of NN material that are disposed on the limb 300A, 300B. For example, each of the multiple distinct pieces of NN material can be layer, placed side-by-side, or a combination thereof. Alternatively, or additionally, each of the multiple distinct pieces of NN material can be spaced apart from one another (e.g., separated by a Newtonian material or an air gap). The NN material can provide dynamic dampening which varies relative to stresses or forces exerted on the one or more components having NN material. For example, the limbs, another component of the archery bow, or a combination thereof can include NN material to reduce or eliminate vibration and/or sound resultant from launching a projectile. Additionally, or alternatively, the NN material can reduce or mitigate damage resultant from an object contacting the archery bow. For example, a shear thickening NN material can be incorporated into the limbs or riser of the archery bow to reduce or prevent damage from an impact (localized dynamic external force—e.g., dropping the bow, transportation hazards, etc.).

Figure 4A:
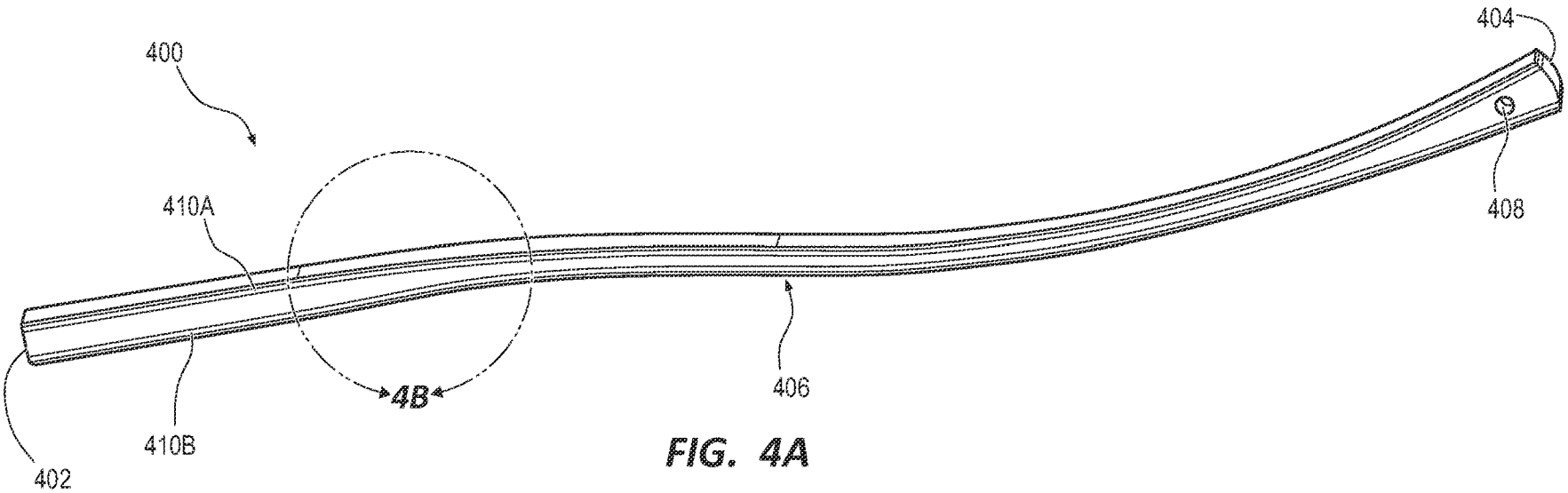
FIG. 4A is a side view of a limb of an archery bow, according to some embodiments.
Figure 4B:
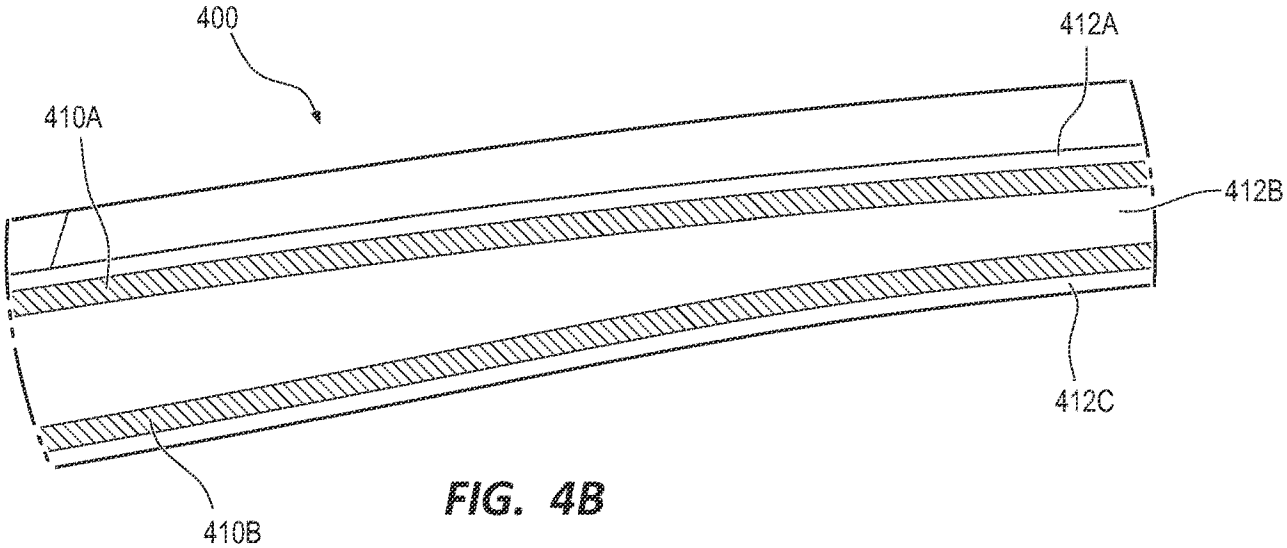
FIG. 4B is a detail view of the limb shown in FIG. 4A.

FIGS. 4A and 4B show a side view and a detailed side view of a limb 400 of an archery bow, according to some embodiments. The limb 400 can be similar to, and can include some or all of, the features of the limbs 200, 300A, 300B. For example, the limb 400 can include a proximal end 402 a distal end 404, and an intermediate portion 406 disposed between the distal end 402 and the proximal end 404. The distal end 404 can include a through-hole 408 or other feature which enables a cam (e.g., upper or lower cam 114, 116) to be rotatably coupled to the limb 400. The limb 400 can include first and second portions of NN material 410A, 410B incorporated as layers within the limb 400. For example, as shown in FIGS. 4A and 4B, the first and second portions of NN material 410A, 410B can be adhered, coupled, or otherwise affixed between other layers of material (layers 412A, 412B, 412C) of the limb 400 (e.g., adhered between layers of the limb 400 formed from fiberglass or another material). Each of the portions of NN material 410A, 410B can extend continuously between the proximal and distal ends 402, 404 of the limb 400. Alternatively, one or more of the portions of NN material 410A, 410B can extend discontinuously between the proximal and distal ends 402, 404 of the limb 400. For example, the portion of NN material 410A can be formed from two or more distinct pieces of NN material that are evenly spaced between the proximal and distal ends 402, 404 of the limb 400.

Figure 5A:
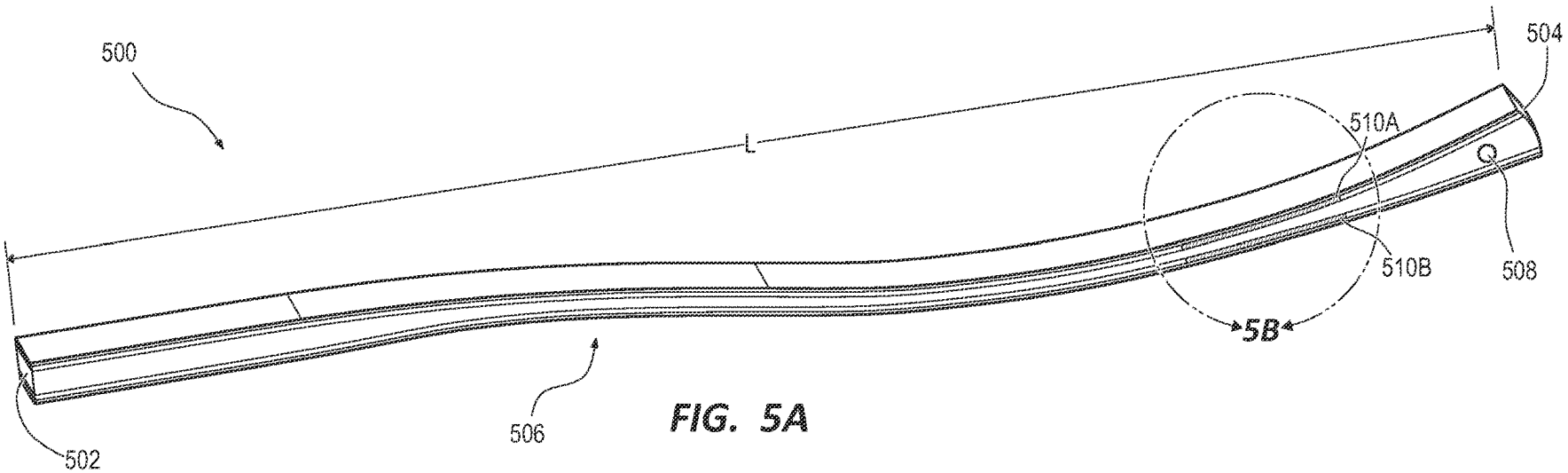
FIG. 5A is an isometric view of a limb of an archery bow, according to some embodiments.
Figure 5B:
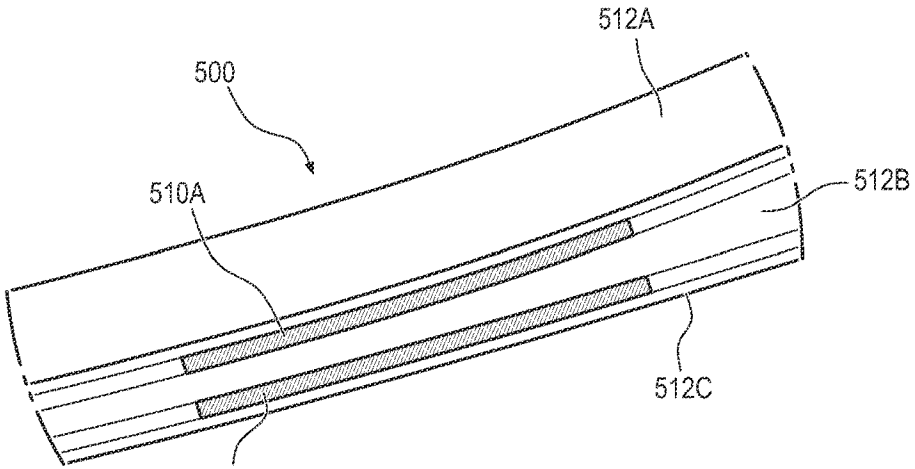
FIG. 5B is a detail view of the limb shown in FIG. 5A.

FIGS. 5A and 5B show a side view and a detailed side view of a limb 500 of an archery bow, according to some embodiments. The limb 500 can be similar to, and can include some or all of, the features of the limbs 200, 300A, 300B, 400. For example, the limb 500 can include a proximal end 502 a distal end 504, and an intermediate portion 506 disposed between the distal end 502 and the proximal end 504. The distal end 504 can include a through-hole 508 or other feature which enables a cam (e.g., upper or lower cam 114, 116) to be rotatably coupled to the limb 500. The limb 500 can include first and second portions of NN material 510A, 510B incorporated within the limb 500. For example, as shown in FIGS. 5A and 5B, the first and second portions of NN material 510A, 510B can be adhered, coupled, or otherwise affixed between other layers of material (layers 512A, 512B, 512C) of the limb 500 (e.g., adhered between layers of the limb 500 formed from fiberglass or another Newtonian material). Each of the portions of NN material 510A, 510B can extend only a portion of the length L extending between the proximal and distal ends 502, 504 of the limb 500. For example, each of the portions of NN material 510A, 510B can extend less than half or less than a quarter of the length L extending between the proximal and distal ends 502, 504 of the limb 500. Alternatively, each of the portions of NN material 510A, 510B can extend more than half or more than three-quarters of the length L extending between the proximal and distal ends 502, 504 of the limb 500.

Figure 6A:
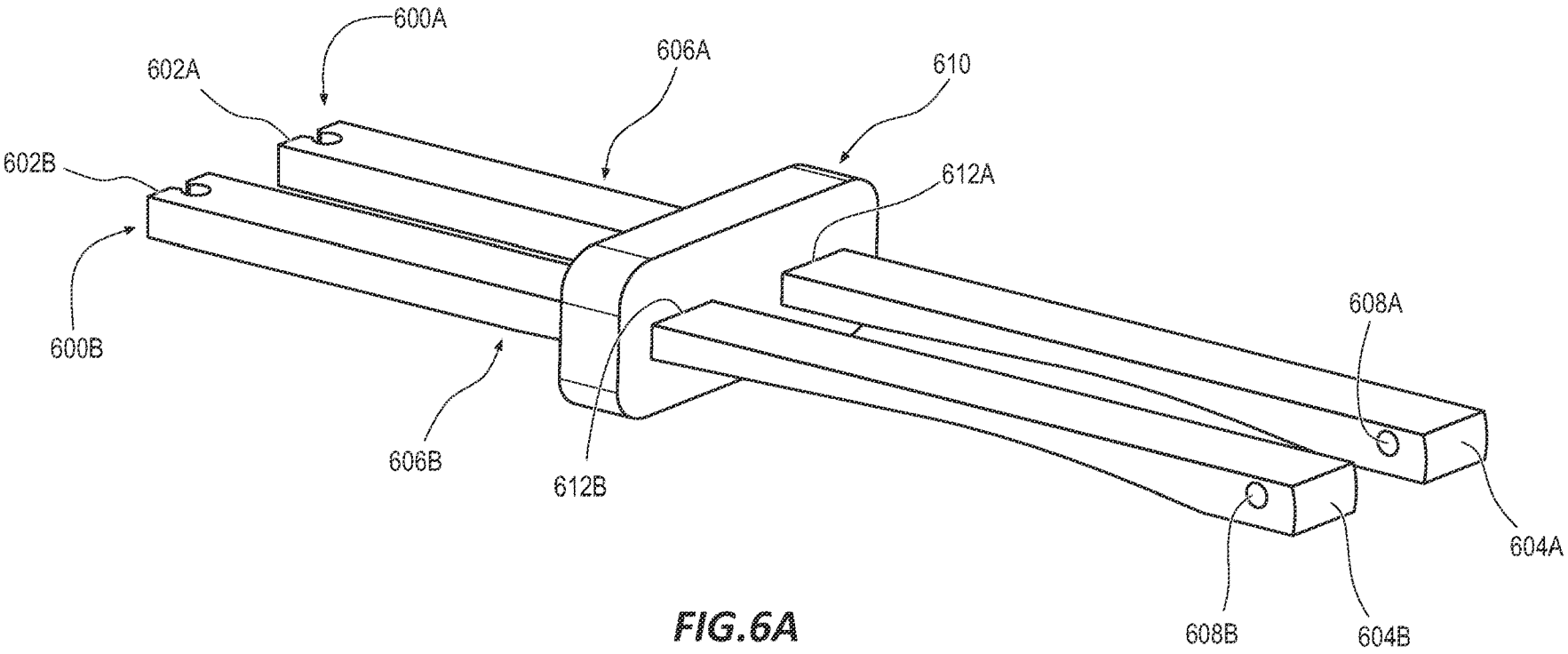
FIG. 6A is an isometric view of a pair of limbs of an archery bow, according to some embodiments.

FIG. 6A is an isometric view of a pair of limbs 600A, 600B of an archery bow, according to some embodiments. Each limb of the pair of limbs 600A, 600B can be similar to, and can include some or all of, the features of the limb 200, 300A, 300B, 400, 500. For example, each limb of the pair of limbs 600A, 600B can include a proximal end 602A, 602B, a distal end 604A, 604B, and an intermediate portion 606A, 606A disposed between the distal end 602A, 602B and the proximal end 604A, 604B. The respective distal ends 604A, 604B can include respective through-holes 608A, 608B or other features which enable a cam (e.g., upper or lower cam 114, 116) to be rotatably coupled between the limbs 600A, 600B.

In some embodiments, an accessory component (e.g., a damping member 610) can be coupled to or otherwise contact at least one of the limbs 600A, 600B. The damping member 610 can contact each of the limbs 600A, 600B to dampen vibrations resultant from launching a projectile from the archery bow. The damping member 610 can be formed using a NN material which has a viscosity that varies relative to rates of forces or rates of stresses applied to the damping member 610. The damping member 610 can include first and second apertures 612A, 612B sized and shaped to enable each limb 600A, 600B to extend through the dampening member 610. Alternatively, or additionally, the damping member 610 can be adhered, fastened, molded, tied, clipped, or otherwise coupled to one or both of the limbs 600A, 600B. The damping member 610 can act as a tether or link which stiffens when a stress or force is applied, such that, the limbs 600A, 600B are effectively or substantially interlocked and flex as a singular structure to resist torsion or twisting. However, prior to launching a projectile (e.g., when the archery bow is in a static state), the damping member 610 can be relatively less rigid or less stiff, such that, each of the limbs 600A, 600B can flex and bend independently of one another.

In some embodiments, the damping member 610 can be held in contact with one or both of the limbs 600A, 600B by a support structure (not shown) extending from a riser (e.g., riser 102) or a pocket coupled to the riser. While the damper member 610 is illustrated as cubic having a rectangular cross-sectional shape, the damper member 610 can form any geometric shape or non-geometric shape having any geometric or non-geometric cross-sectional shape. While the damping member 610 is illustrated as contacting particular locations on the intermediate portions 606A, 606B of the limbs 600A, 600B with respect to the proximal ends 602A, 602B and distal ends 604A, 604B, the damping member 610 can be disposed at any distance (e.g., distances $D_1$, $D_2$ shown in FIG. 2) with respect to the proximal ends 602A, 602B and distal ends 604A, 604B.

While the damping member 610 is shown as singular or unitary piece of NN material in FIG. 6A, the damping member 610 can be formed of multiple distinct pieces of NN material that are molded, adhered, fastened, or otherwise coupled together. Alternatively, or additionally, the damping member 610 can be formed from a combination of NN material and Newtonian material, such that, only a portion of the damping member 610 has a viscosity that varies relative to forces or stress applied to the damping member 610. For example, the damping member 610 can be co-molded using NN material and Newtonian material.

Figure 6B:
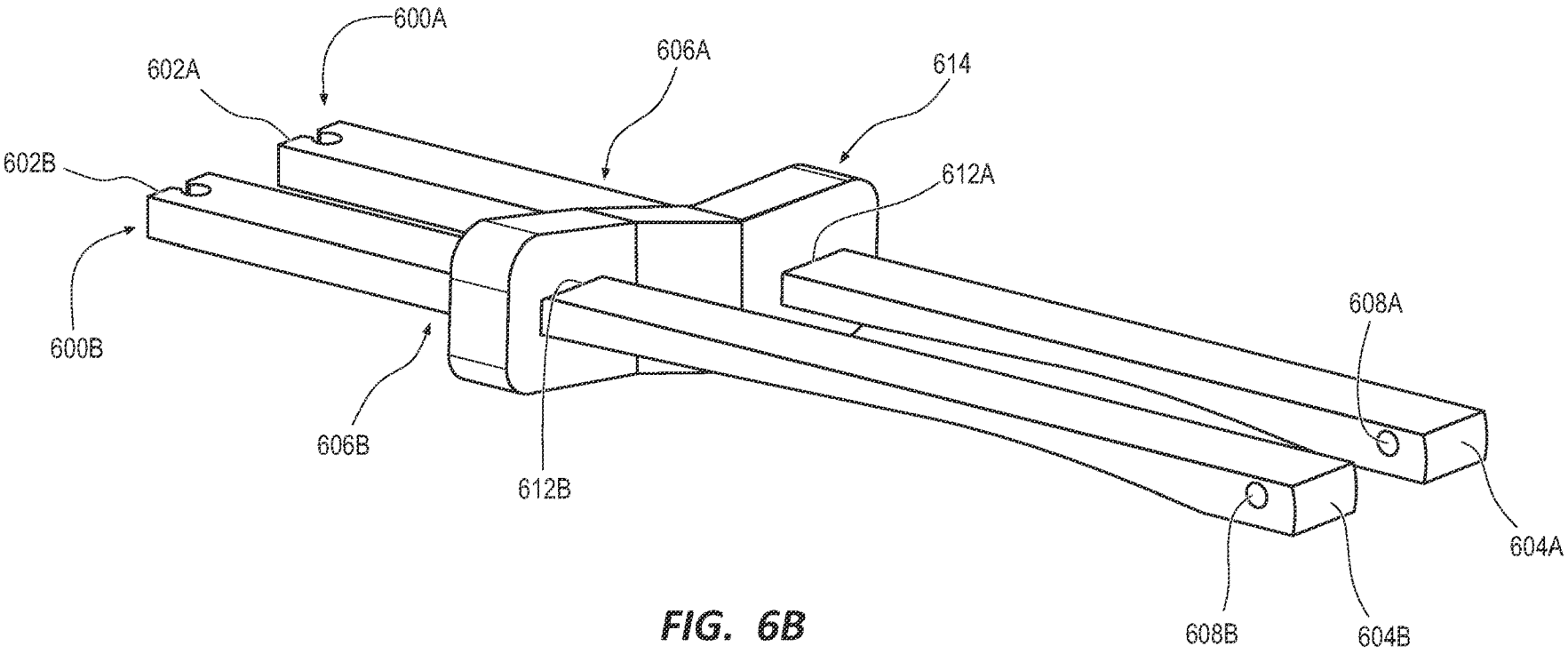
FIG. 6B is an isometric view of a pair of limbs of an archery bow, according to some embodiments.

FIG. 6B is an isometric view of the pair of limbs 600A, 600B including an accessory component (e.g., a damping member 614) coupled to or otherwise contacting at least one of the limbs 600A, 600B. The damping member 614 can contact each of the limbs 600A, 600B to dampen vibrations resultant from launching a projectile from the archery bow. The damping member 614 can be formed using a NN material which has a viscosity that varies relative to a rate of force or rate of stress applied to the damping member 614. The damping member 614 can be similar to, and can include some or all of, the features of the damping member 610. For example, the damping member 614 can include first and second apertures 612A, 612B sized and shaped to enable each limb 600A, 600B to extend through the dampening member 614. Alternatively, or additionally, the damping member 614 can be adhered, fastened, molded, tied, clipped, or otherwise coupled to one or both of the limbs 600A, 600B. The damping member 614 can act as a tether or link which stiffens when a stress or force is applied, such that, the limbs 600A, 600B are effectively or substantially interlocked and flex as a singular structure to resist torsion or twisting. However, prior to launching a projectile (e.g., when the archery bow is in a static state), the damping member 614 can be relatively less rigid or less stiff, such that, each of the limbs 600A, 600B can flex and bend independently of one another.

Unlike the damping member 610 shown in FIG. 6A, the damping member 614 illustrated in FIG. 6B can contact non-symmetrical locations on the intermediate portions 606A, 606B of the limbs 600A, 600B with respect to the proximal ends 602A, 602B and distal ends 604A, 604B. In other words, the damping member 614 can contact the limb 600A at a first distance from the proximal end 602A while the damping member 614 can contact the limb 600B at a second distance from the proximal end 602B. The first and second distances can be different, such that, the damping member 614 affects the movement of each limb 600A, 600B differently when a projectile is launched from the archery bow. Contacting the limbs 600A, 600B at non-symmetrical locations can alter movement characteristics of one or both limbs 600A, 600B to increase performance of the archery bow. For example, altering the movement characteristics of one or both limbs 600A, 600B can offset undesirable torque induced in the cam and/or limb due to shifting of tensions from cables (offset relative to a central point between the limbs) to the bowstring (centered between the limbs).

While the damping member 614 is shown as singular or unitary piece of NN material in FIG. 6B, the damping member 614 can be formed of multiple distinct pieces of NN material that are molded, adhered, fastened, or otherwise coupled together. Alternatively, or additionally, the damping member 614 can be formed from a combination of NN material and Newtonian material, such that, only a portion of the damping member 614 has a viscosity that varies relative to loading rates of forces or stresses applied to the damping member 614. For example, the damping member 614 can be co-molded using NN material and Newtonian material.

While FIGS. 1-6B described various example embodiments where NN materials were incorporated into or on one or more limbs of the archery bow, other components of the archery bow, such as, the bowstring, cables, riser, sight, stabilizer, quiver, rest, or other component can additionally, or alternatively, include a NN material or an accessory component incorporating a NN material. In some embodiments, one or more accessory components incorporating NN material can be adhered, fastened, clipped, crimped, molded, welded, bonded, inserted, or otherwise affixed to one or more components of the archery bow. For example, one or more accessory components incorporating NN material can be fastened or otherwise coupled to an external surface of a riser. Additionally, or alternatively, one or more portions of NN material can be disposed within one or more cavities formed within a riser having a hollow tubular structure, such as, a riser formed from one or more carbon fiber tubes. The one or more portions of NN material can mitigate or reduce vibration resultant of launching a projectile from the archery bow.

Figure 7A:
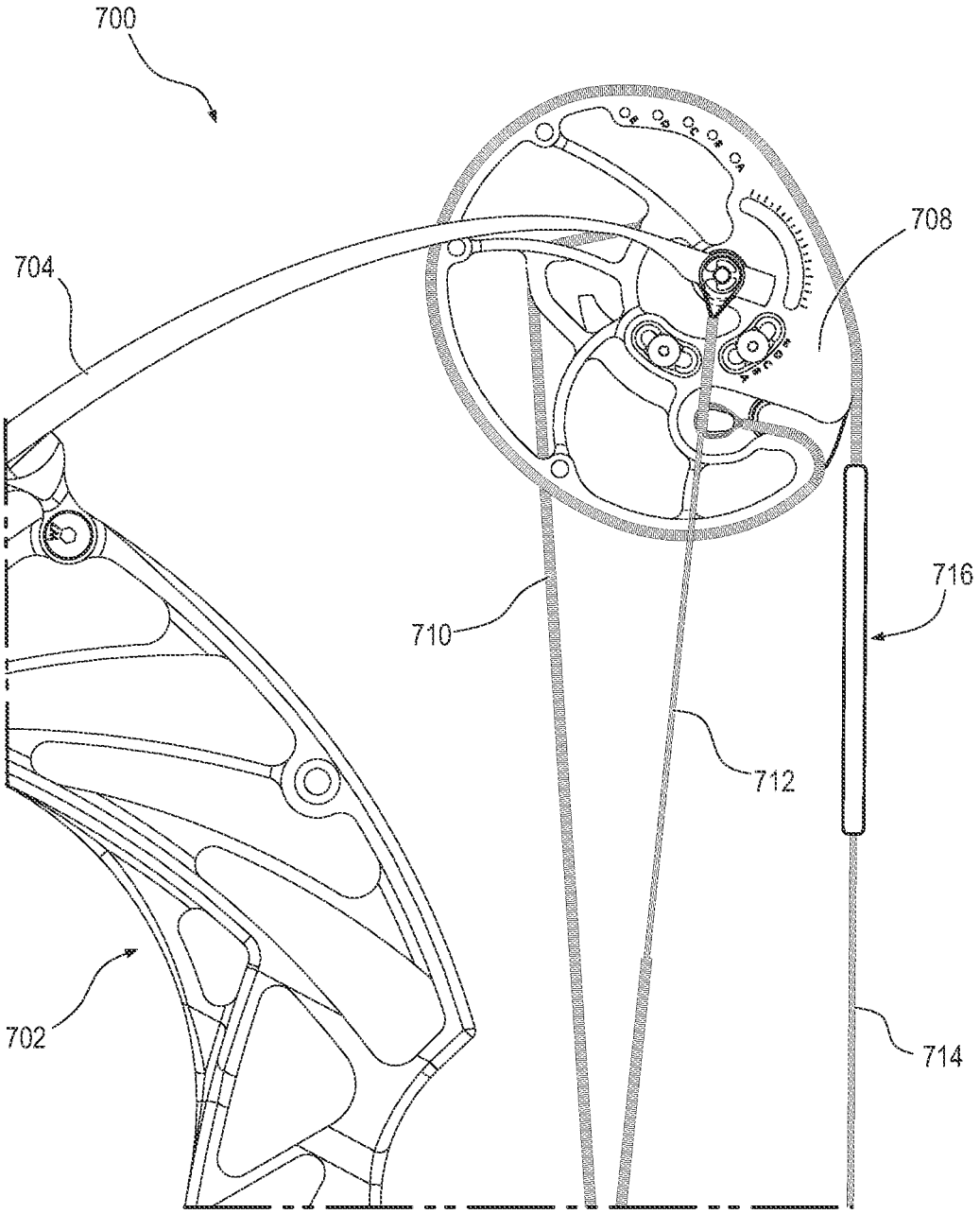
FIG. 7A is a detail view of an archery bow, according to some embodiments.

FIG. 7A is a detail view of a portion of an archery bow 700, according to some embodiments. The archery bow 700 can be substantially similar to, and can include some or all of, the features of the archery bow 100. For example, the archery bow 700 can include a riser 702, a limb 704, an upper cam 708, a first cable 710, a second cable 712, and a bowstring 714. The archery bow 700 can include one or more string dampers 716 coupled to the bowstring 714 and configured to reduce or mitigate vibration resultant from launching a projectile from the archery bow 700. The string damper 716 can be at least partially formed from a NN material, such that, a viscosity of the string damper 716 can vary relative to a rate of force or rate of stress applied to the string damper 716.

In some embodiments, the one or more string dampers 716 can be at least partially formed of a NN material, such as, a polymer or Non-Newtonian fluid (NN fluid). For example, the string damper 716 can be formed from an outer container or vessel at least partially filled within an NN fluid and subsequently coupled or affixed to the bowstring 714. In some embodiments, the NN material (e.g., a shear thickening NN fluid) incorporated into the string damper 716 can become rigid or otherwise have a relatively higher viscosity when a high rate of stress or high rate of forces are induced on the string damper 716 (e.g., when a projectile is launched from the archery bow 700) to cause the portion of the bowstring 714 adjacent the string damper 716 to resist bending and deformation. Alternatively, the NN material (e.g., a shear thinning NN fluid) incorporated into the string damper 716 can become flexible or otherwise have a relatively lower viscosity when stress or forces are induced on the string damper 716 (e.g., when a projectile is launched from the archery bow 700). The non-linear correlation between viscosity and stress or force of the string damper 716 can be beneficial, for example, in mitigating or reducing vibrations resultant of a projectile being launched from the archery bow 700. For example, a temporarily rigid or stiff string damper 716 can cause at least a portion of the bowstring 714 to resist bending and deformation immediately after the projectile is launched from the bowstring 714.

The string damper 716 can be disposed anywhere along the section of the bowstring 714 extending between the upper cam 708 and the lower cam (now shown). For example, as shown in FIG. 7A, the string damper 716 can be disposed on the bowstring 714 near the upper cam 708. Alternatively, or additionally, the string damper 716 can be disposed on the bowstring 714 near a lower cam (not shown) of the archery bow 700. The string damper 716 can form any geometric or non-geometric shape. In some embodiments, the string damper 716 can extend parallel to the bowstring 714, as shown in FIG. 7A. In other embodiments, the string damper 716 can extend perpendicular to the bowstring 714. While the string damper 716 is shown as singular or unitary piece of NN material in FIG. 7A, the string damper 716 can be formed of multiple distinct pieces of NN material that are molded, adhered, fastened, or otherwise coupled together. Alternatively, or additionally, the string damper 716 can be formed from a combination of NN material and Newtonian material, such that, only a portion of the string damper 716 has a viscosity that varies relative to rate of forces or rate of stress applied to the string damper 716. For example, the string damper 716 can be co-molded using a combination of an NN material and a Newtonian material.

In some embodiments, the string damper 716 can be crimped around the bowstring 714 to couple the string damper 716 to the bowstring 714. In some embodiments, the string damper 716 can include one or more apertures which enable the bowstring 714 to extend through the string damper 716 to couple the string damper 716 to the bowstring 714. Alternatively, or additionally, the string damper 716 can be adhered, fastened, molded, tied, clipped, or otherwise coupled to the bowstring 714. While the string damper 716 is shown in FIG. 7A as being coupled to the bowstring 714, one or more string dampeners incorporating NN material can additionally, or alternatively, be affixed to the first cable 710 and/or the second cable 712.

Figure 7B:
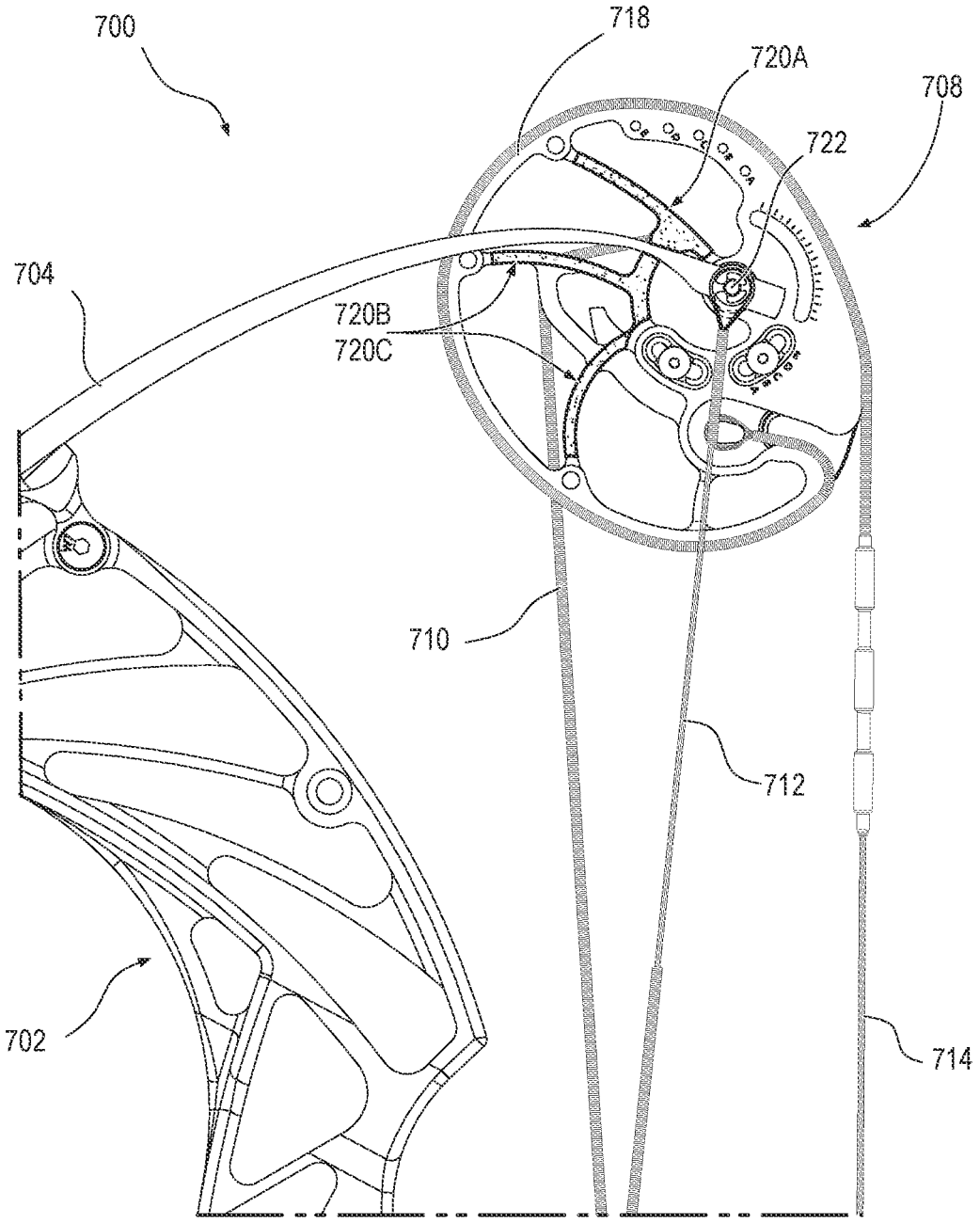
FIG. 7B is a detail view of an archery bow, according to some embodiments.

NN materials can be additionally, or alternatively, incorporated into one or more of the cams (e.g., upper cam 114 and lower cam 116 shown in FIG. 1). As shown in FIG. 7B, the upper cam 708 can include a string track 718 extending around a periphery of the upper cam 708. When the archery bow is drawn and released by an archer, the bowstring 714 can be let out of the string track 718 and subsequently taken up by the string track 718. The string track 718 can define a depth which partially receives the bowstring 714. In other words, the string track 718 can have a diameter that sufficiently catches and retains the bowstring 714 to prevent the bowstring 714 from derailing or unintentionally exiting the string track 718. The string track 718 can be at least partially supported by one or more spokes or structural members 720A, 720B, 720C of the upper cam 708. The one or more structural members 720A-720C can define apertures or through-holes within the upper cam 708, such that, the one or more structural members 720A-720C generally extend radially between an axis of rotation 722 of the upper cam 708 and the string track 718. While the structural members 720A-720C are depicted as a spoke system, the structural members 720A-720C can be formed as any other support structure, for example, a hexagonal support structure or other support structure.

The one or more structural members 720A-720C can prevent the upper cam 708 from bending or breaking from significant loading induced on the upper cam 708 when an arrow is launched from the archery bow. For example, when the bowstring is released and the archery bow transitions from a fully drawn state to a brace state (i.e., the state shown in FIG. 1), the upper cam 708 is abruptly prevented from continued rotation by the cables 710, 712 and the bowstring 714. This abrupt stop can induce vibrations and other forces into the archery bow which can cause archer fatigue, can induce errant movements of the bow or projectile, can reduce the life of the archery bow, and can generate unwanted noise.

In some embodiments, one or more of the structural members 720A-720C can be entirely or partially formed from an NN material. One or more structural members 720A-720C formed from one or more types of NN material can reduce or eliminate at least one of high-frequency vibrations and low-frequency vibrations to increase the longevity of the archery bow, improve the performance of the archery bow, and improve the shooting experience for the archer. For example, one or more structural members 720A-720C can be formed from a shear thickening NN material which has a stiffness that correlates to a change in the rate of forces applied to the upper cam 708.

Figure 7C:
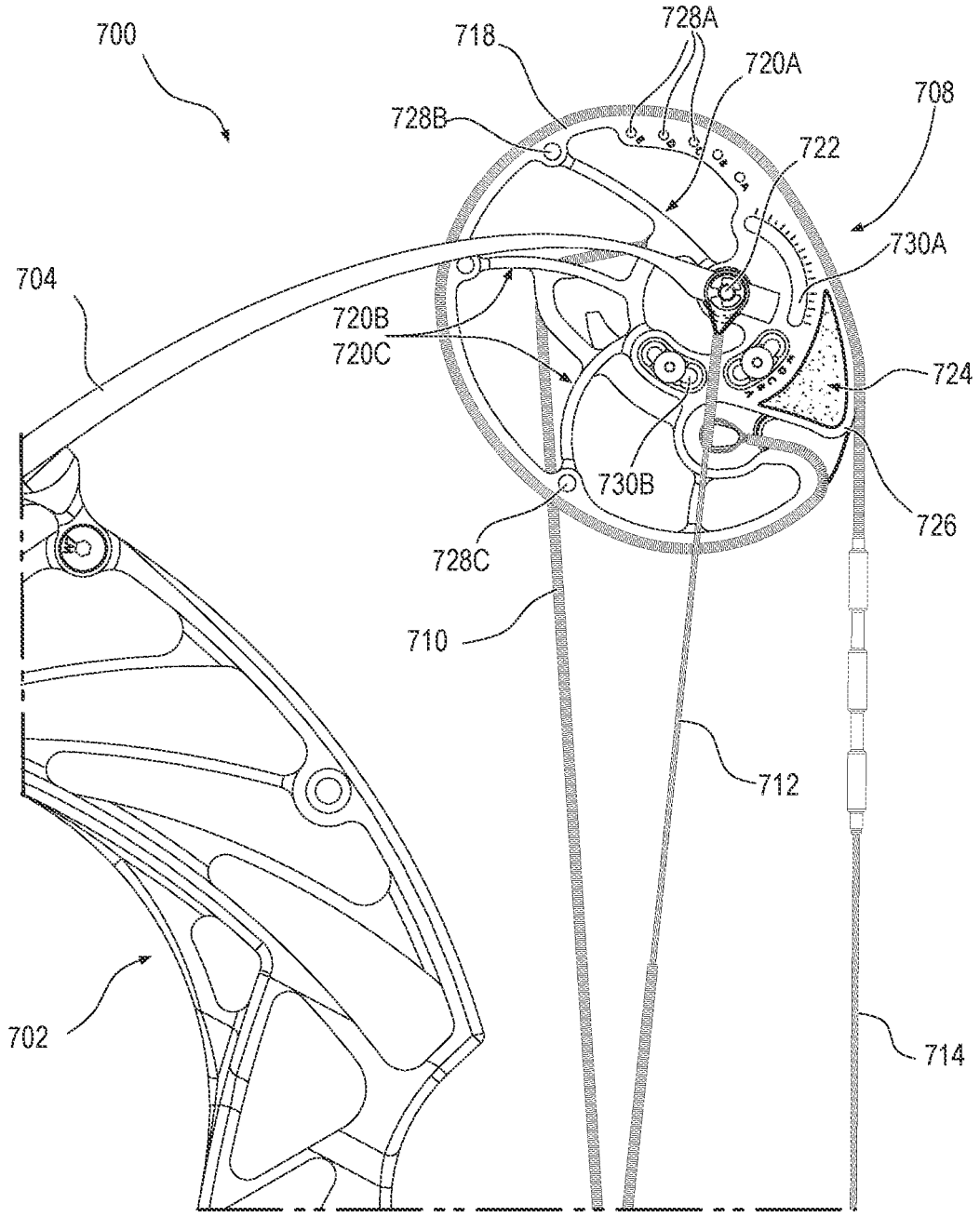
FIG. 7C is a detail view of an archery bow, according to some embodiments.

Additionally, or alternatively, one or more portions of NN material can be incorporated into other elements of one or more of the cams. FIG. 7C is a detail view of a portion of an archery bow 700 including a NN material incorporated as a damper 724 into the upper cam 708. The damper 724 can be sized and shaped to fit within a recess or aperture formed within the upper cam 708. In some embodiments, a portion of the damper 724 can be disposed within the string track 718 and contact the bowstring 714. For example, the damper 724 can be disposed within a recess or through-hole that is in fluid communication with the string track 718, such that, a portion of the damper 724 extends from the recess or through-hole into the string track 718.

While the damper 724 is depicted as being disposed at or near a rear-ward lobe 726 of the upper cam 708, one or more dampers 724 can be disposed anywhere on the upper cam 708 in other embodiments. For example, one or more dampers 724 can be disposed within a recess or through-hole formed by any other element of the upper cam 708 (e.g., the string track 718, the one or more structural members 720A-720C, apertures 728A-728C, slots 730A, 730B, a combination thereof, etc.). Additionally, or alternatively, the damper 724 can be adhered, fastened, tied, molded, or otherwise coupled to an element of the upper cam 708, such as, the one or more support members 720A-720C.

Figure 7D:
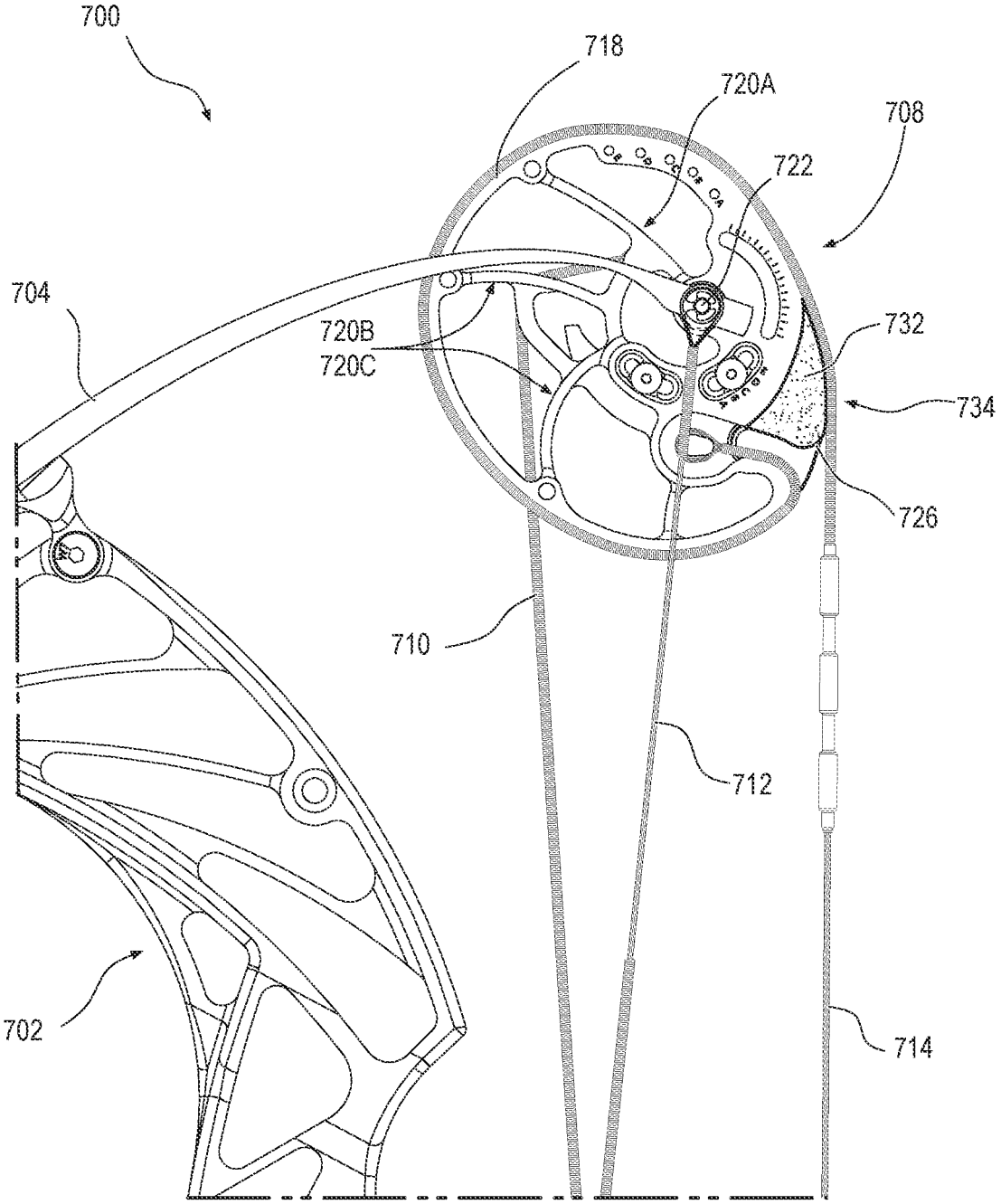
FIG. 7D is a detail view of an archery bow, according to some embodiments.

FIG. 7D is a detail view of a portion of an archery bow 700 including a NN material 732 incorporated as the lobe 726 of the upper cam 708. The NN material 732 can be adhered, fastened, welded, molded, or otherwise coupled to the upper cam 708. While the NN material 732 is shown in a particular positon on the upper cam 708 and having a particular shape in FIG. 7D, the NN material 732 can be disposed anywhere on the upper cam 708 and define any shape. Moreover, all of the principles discussed herein are equally applicable to a lower cam (e.g., lower cam 116 shown in FIG. 1).

In some embodiments, the NN material 732 can form or define a portion of the string track 718, such that, a section of the bowstring 714 comes into contact with the NN material 732 when a projectile is launched from the archery bow. For example, a section 734 of the bowstring 714 can slap or impact the NN material 732 when the archery bow reaches a brace condition (see FIG. 1) and the projectile is launched from the bowstring 714. This slap or impact can exert a significant and near-instantaneous force on the NN material 732 to cause the NN material 732 to rapidly increase in stiffness or rigidity to better absorb the impact and reduce or prevent damage caused by the impact. Unlike a Newtonian material, which can fail upon impact of the bowstring 714 (e.g., degrade, break, tear, cut, deform, etc.), the NN material 732 can have a resistance to deformation that increase at a rate that correlates with a rate of force generated by the impact of the section 734 of the bowstring 714 upon the NN material 732. Even if a relatively rigid Newtonian material were substituted for the NN material 732, the Newtonian material would be prone to crack and break after repeated use of the archery bow. Moreover, the constantly rigid Newtonian material would not dynamically dampen or absorb vibration generated by the impact and other components of the archery bow could fail as a result.

Figure 8A:
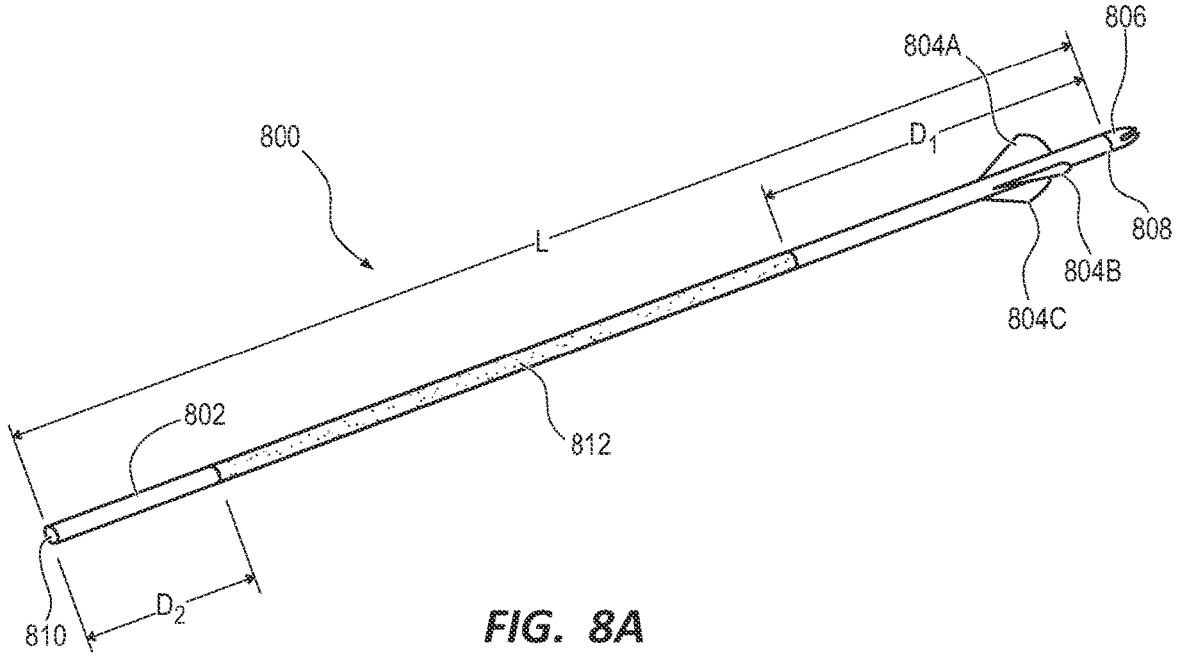
FIG. 8A is an isometric view of a projectile, according to some embodiments.
Figure 8B:
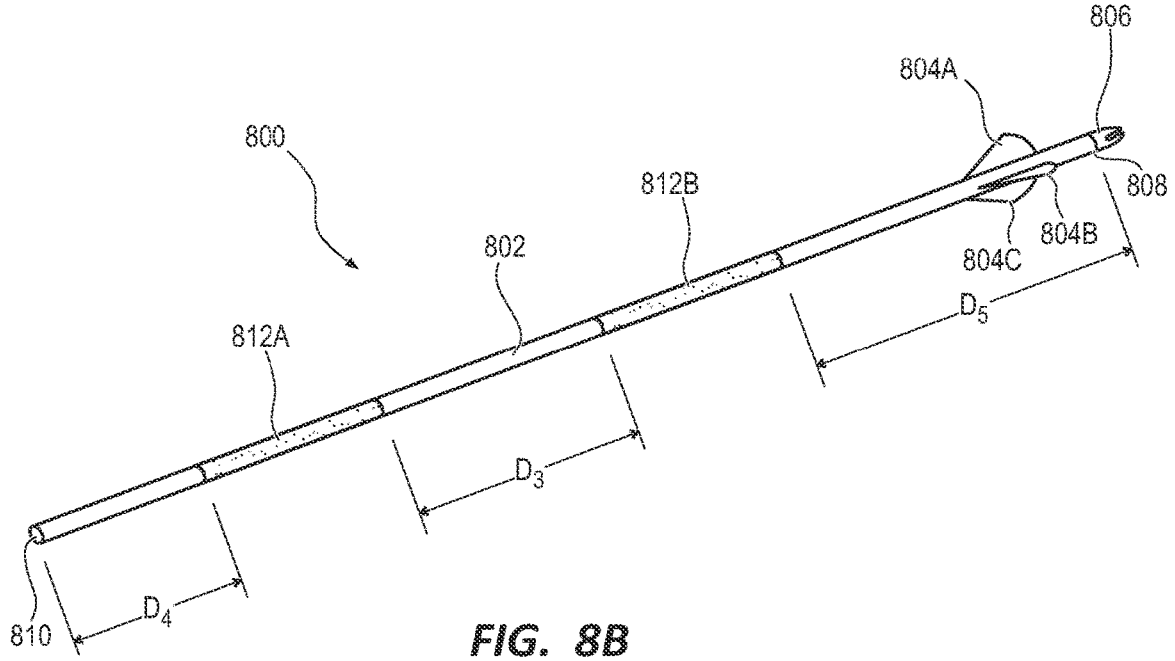
FIG. 8B is an isometric view of a projectile, according to some embodiments.
Figure 8C:
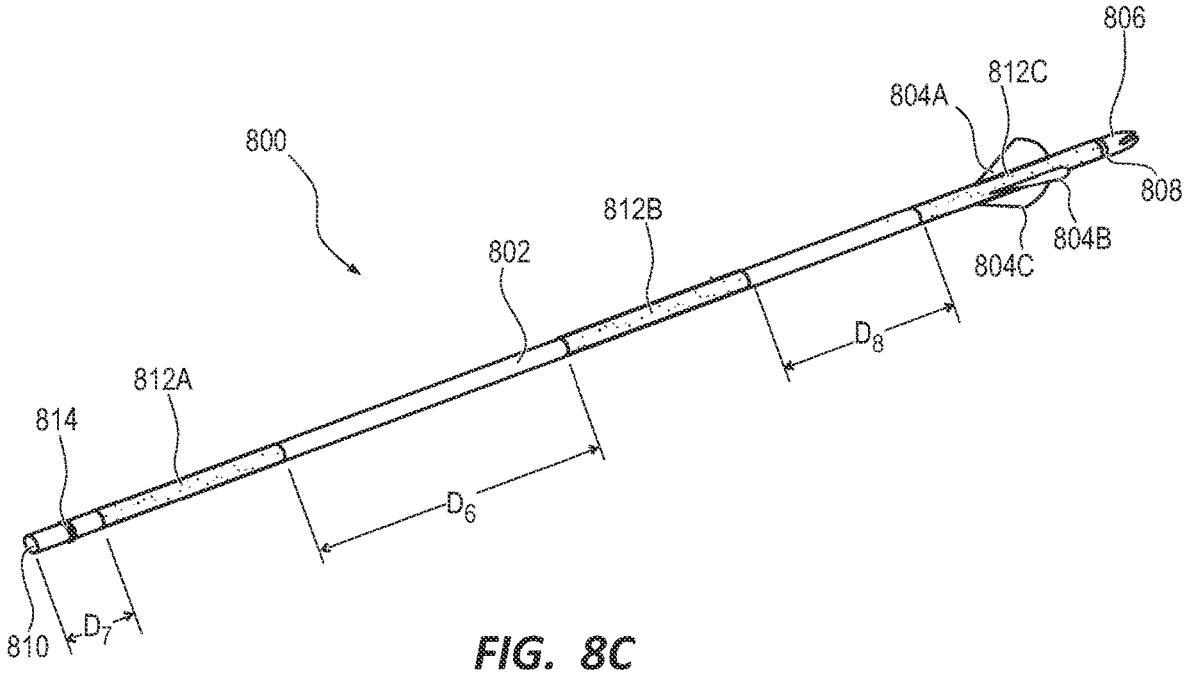
FIG. 8C is an isometric view of a projectile, according to some embodiments.

According to another aspect of the present disclosure, a NN material can be incorporated on or within a projectile, such as, an arrow, a bolt, or other projectile, for shooting from an archery bow. FIGS. 8A-8C show non-limiting examples of a projectile having one or more portions of NN material incorporated within the projectile. FIG. 8A is an isometric view of a projectile (e.g., arrow 800), according to some embodiments. The arrow 800 can include a cylindrical shaft 802, optionally, one or more vanes 804A, 804B, 804C, and a nock 806. The cylindrical shaft 802 can include a proximal end 808 and a distal end 810. The cylindrical shaft 802 can include a metal (e.g., an aluminum alloy, steel, etc.), carbon fiber, fiber glass, a polymer, a combination thereof, or any other material. The nock can be coupled to the proximal end 808 of the cylindrical shaft 802 and be configured to engage with a bowstring (e.g., bowstring 714). The one or more vanes 804A, 804B, 804C can be adhered or otherwise affixed to the cylindrical shaft 802, for example, near the proximal end 808 of the cylindrical shaft 802.

In some embodiments, one or more of the vanes 804A, 804B, 804C can be formed from one or more types of NN material for improved aerodynamic profile under dynamic loading, but also allow for soft, flexible movement under static loading. For example, one or more of the vanes 804A, 804B, 804C can be formed from a shear thickening NN material which causes the one or more of the vanes 804A, 804B, 804C to increase in rigidity while the arrow 800 is under a dynamic state or load (e.g., being launched from an archery bow, during flight, upon impacting a target, or a combination thereof). A relatively more rigid vane can be beneficial, for example, by modifying drag characteristics of the arrow 800 which are generated by the one or more vanes 804A, 804B, 804C during flight. Alternatively, or additionally, one or more relatively more rigid vanes can be beneficial in preventing the arrow 800 from passing entirely through a target when the target is incapable of completely eliminating the inertia of the arrow 800.

In some embodiments, the arrow 800 can contact a portion of the riser or a portion of an arrow rest when launched from the archery bow. For example, one or more of the vanes 804A, 804B, 804C can contact the riser or arrow rest as the arrow 800 transitions away from the bowstring. This contact can alter flight characteristics of the arrow 800, such as, altering trajectory of the arrow 800 or an orientation of the arrow 800 relative to a target. One or more of the vanes 804A, 804B, 804C can be at least partially formed from a NN material that mitigates undesirable consequences of the arrow 800 contacting the riser or arrow rest. For example, one or more of the vanes 804A, 804B, 804C can be formed from a shear thinning NN material which deforms upon contact with the riser or arrow rest to mitigate undesirable consequences of the contact.

The arrow 800 can also include one or more portions of NN material 812 disposed within or on the cylindrical shaft 802. For example, the portion of NN material 812 can be disposed within a cavity or volume defined by the cylindrical shaft 802. The portion of NN material 812 can temporarily increase or decrease in viscosity due to rate of stresses or rate of forces induced on the NN material 812 while the arrow is launched, in flight, impacting the target, or a combination thereof. In other words, the NN material 812 can dynamically vary a stiffness or rigidity of the arrow 800, such that, the arrow 800 has a first stiffness or rigidity while in a dynamic state and a second stiffness or rigidity in a static state. The variable stiffness or rigidity of the arrow 800 can be beneficial, for example, by minimizing a lateral offset the arrow must be aimed relative to the target due to deficiencies of the arrow related to stiffness (i.e., the archer's paradox). In some embodiments, the first stiffness can be greater than the second stiffness, such as when the NN material 812 is shear thickening, and thereby reduce energy loss caused by bending oscillations undertaken by the arrow 800 while in flight. In some embodiments, the first stiffness can be less than the second stiffness, such as, when the NN material 812 is shear thinning.

The NN material 812 can be offset or spaced a distance $D_1$ from the proximal end 808 of the cylindrical shaft 802. For example, the distance $D_1$ can be less than about 25 millimeters, between about 25 millimeters and about 50 millimeters, between about 50 millimeters and about 75 millimeters, between about 75 millimeters and about 150 millimeters, or greater than 150 millimeters. Alternatively, the NN material 812 can be disposed flush with or at the proximal end 808 of the cylindrical shaft 802. Additionally, or alternatively, the NN material 812 can be offset or spaced a distance $D_2$ from the distal end 810 of the cylindrical shaft 802. For example, the distance $D_2$ can be less than about 25 millimeters, between about 25 millimeters and about 50 millimeters, between about 50 millimeters and about 75 millimeters, between about 75 millimeters and about 150 millimeters, or greater than 150 millimeters. Alternatively, the NN material 812 can be disposed flush with or at the distal end 810 of the cylindrical shaft 802. In some embodiments, the NN material 812 can be disposed nearer the distal end 810 of the cylindrical shaft 802 than the proximal end 808 of the cylindrical shaft 802. Alternatively, the NN material 812 can be disposed nearer the proximal end 808 of the cylindrical shaft 802 than the distal end 810 of the cylindrical shaft 802.

In some embodiments, as shown in FIG. 8A, the NN material 812 can extend along the volume or cavity defined by the cylindrical shaft 802. For example, the NN material 812 can extend a majority of a length L between the proximal end 808 and the distal end 810 of the cylindrical shaft 802. In other embodiments, the NN material 812 may not extend a majority of the length L between the proximal end 808 and the distal end 810 of the cylindrical shaft 802. While the NN material 812 is described as being disposed within the cylindrical shaft 802, the NN material 812 can additionally, or alternatively, be disposed on an external surface of the cylindrical shaft 802. For example, one or more portions of the NN material 812 can be adhered, fastened, clipped, bonded, molded, or otherwise coupled to an external or exterior surface of the cylindrical shaft 802, the nock 806, or another component of the arrow 800 (e.g., an insert or outsert, not shown).

In some embodiments, as shown in FIG. 8B, the arrow 800 can include more than one NN material disposed within the cylindrical shaft 802. FIG. 8B is an isometric view of a projectile (e.g., arrow 800), according to some embodiments. The arrow 800 includes a first portion of NN material 812A and a second portion of NN material 812B disposed within a cavity or volume defined by the cylindrical shaft 802. The first and second portions of NN material 812A, 812B can include the same NN material or different NN materials (i.e., NN materials having differing material properties, such as, viscosity, density, young's modulus, etc.). The first portion of NN material 812A can be offset or spaced a distance $D_3$ from the second portion of NN material 812B. For example, the distance $D_3$ can be less than about 5 millimeters, between about 5 millimeters and about 25 millimeters, between about 25 millimeters and about 50 millimeters, between about 50 millimeters and about 100 millimeters, or greater than 100 millimeters.

The first portion of NN material 812A can be offset or spaced a distance $D_4$ from the distal end 810 of the cylindrical shaft 802. For example, the distance $D_4$ can be less than about 25 millimeters, between about 25 millimeters and about 50 millimeters, between about 50 millimeters and about 75 millimeters, between about 75 millimeters and about 150 millimeters, or greater than 150 millimeters. Alternatively, the first portion of NN material 812A can be disposed flush with or at the distal end 810 of the cylindrical shaft 802. Additionally, or alternatively, the second portion of NN material 812B can be offset or spaced a distance $D_5$ from the proximal end 808 of the cylindrical shaft 802. For example, the distance $D_5$ can be less than about 25 millimeters, between about 25 millimeters and about 50 millimeters, between about 50 millimeters and about 75 millimeters, between about 75 millimeters and about 150 millimeters, or greater than 150 millimeters. Alternatively, the second portion of NN material 812B can be disposed flush with or at the proximal end 808 of the cylindrical shaft 802.

In some embodiments, as shown in FIG. 8C, the arrow 800 can include more than two portions of NN material disposed within the cylindrical shaft 802. FIG. 8C is an isometric view of a projectile (e.g., arrow 800), according to some embodiments. The arrow 800 includes a first portion of NN material 812A, a second portion of NN material 812B, and a third portion of NN material 812C disposed within a cavity or volume defined by the cylindrical shaft 802. The first, second, and third portions of NN material 812A, 812B, 812C can include the same NN material or different NN materials (i.e., NN materials having differing material properties, such as, viscosity, density, young's modulus, shear thinning, shear thickening etc.). For example, the first and third portions of NN material 812A, 812C can be a shear thinning material to dampen out high frequency vibrations dynamically, while the second portion of NN material 812B can be a centrally located shear thickening material to resist dynamic deflection (stiffen) and dampen lower frequency vibrations. In some examples, a first type of NN material can be placed at the ends of the cylindrical shaft 802 and a different type of NN material can be disposed at or near the center of the cylindrical shaft 802 to provide an optimally damped structure.

The first portion of NN material 812A can be offset or spaced a distance $D_6$ from the second portion of NN material 812B. For example, the distance $D_6$ can be less than about 5 millimeters, between about 5 millimeters and about 25 millimeters, between about 25 millimeters and about 50 millimeters, between about 50 millimeters and about 100 millimeters, or greater than 100 millimeters. The first portion of NN material 812A can be offset or spaced a distance $D_7$ from the distal end 810 of the cylindrical shaft 802. For example, the distance $D_7$ can be less than about 5 millimeters, between about 5 millimeters and about 25 millimeters, between about 25 millimeters and about 50 millimeters, or greater than 50 millimeters. Alternatively, the first portion of NN material 812A can be disposed flush with or at the distal end 810 of the cylindrical shaft 802.

The second portion of NN material 812B can be offset or spaced a distance $D_8$ from the third portion of NN material 812C. For example, the distance $D_8$ can be less than about 5 millimeters, between about 5 millimeters and about 25 millimeters, between about 25 millimeters and about 50 millimeters, between about 50 millimeters and about 100 millimeters, or greater than 100 millimeters. The third portion of NN material 812C can be offset or spaces a distance from the proximal end 808, such as, between about 5 millimeters and about 25 millimeters, between about 25 millimeters and about 50 millimeters, or greater than 50 millimeters. Alternatively, the third portion of NN material 812C can be disposed flush with or at the proximal end 808 of the cylindrical shaft 802.

In some embodiments, the arrow 800 can additionally, or alternatively, include one or more portions of NN material 814 disposed about a periphery or part of the periphery of the cylindrical shaft 802. In some examples, the portion of NN material 814 can resemble a gasket or o-ring which is adhered, fastened, welded, or otherwise affixed to the cylindrical shaft 802. The portion of NN material 814 can be shear thickening and stiffen upon impacting the target to limit or reduce a depth to which the arrow 800 can penetrate the target. When the arrow 800 returns to a static state (e.g., at rest within the target), the portion of NN material 814 can be relatively less stiff to enable extraction of the arrow 800 from the target with a relatively lesser force. While the portion of NN material 814 in FIG. 8C is shown as being disposed near the distal end 810 of the cylindrical shaft 802, one or more portions of NN material 814 can be disposed at any location on the cylindrical shaft 802 between the distal end 810 and the proximal end 808 in other embodiments. While the portion of NN material 814 in FIG. 8C is depicted as resembling an o-ring, the one or more portions of NN material 814 can extend along the cylindrical shaft 802 in other embodiments.

Figure 9A:
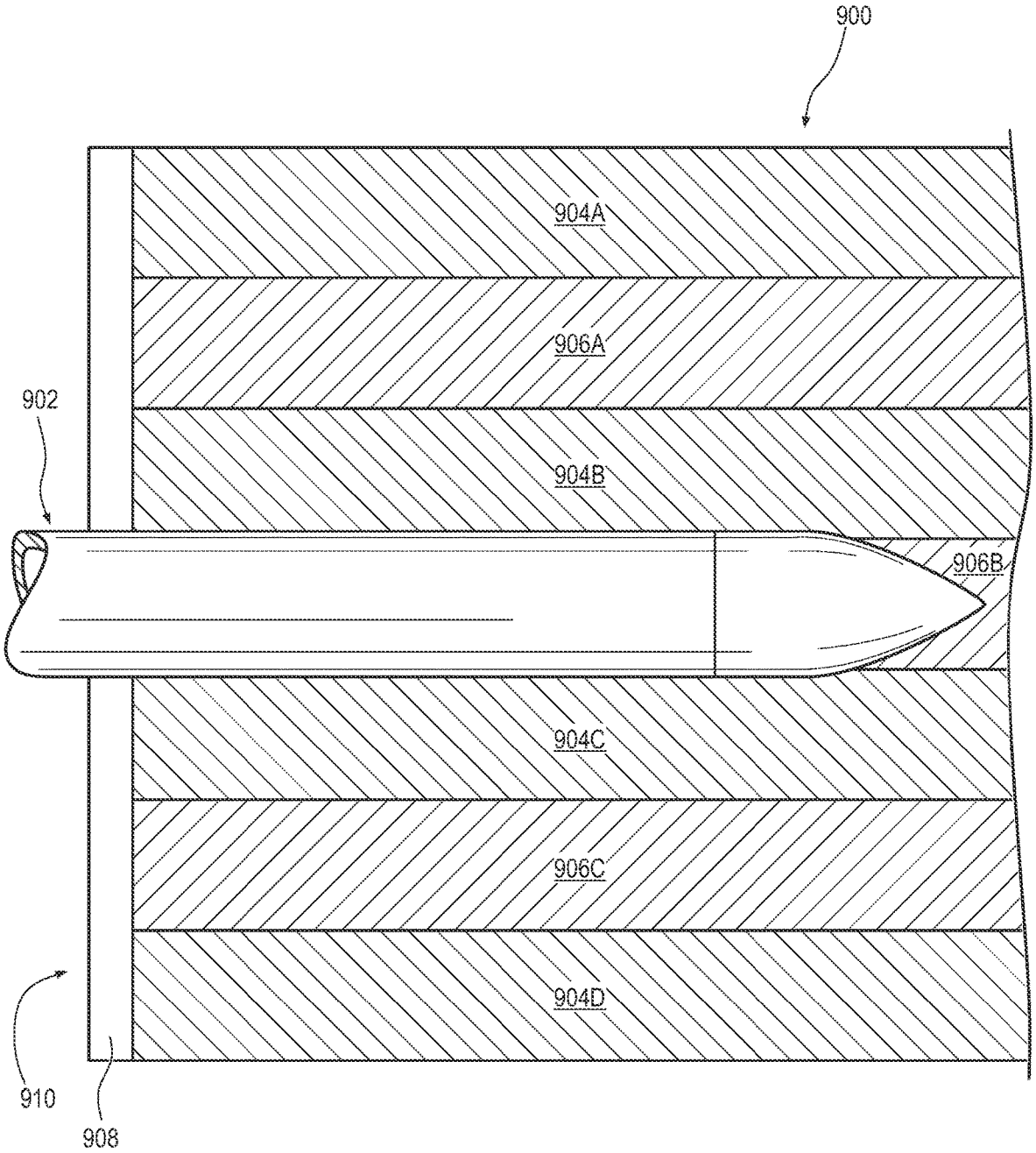
FIG. 9A is a cross-sectional detail view of an archery target and a projectile partially disposed within the archery target, according to some embodiments.
Figure 9B:
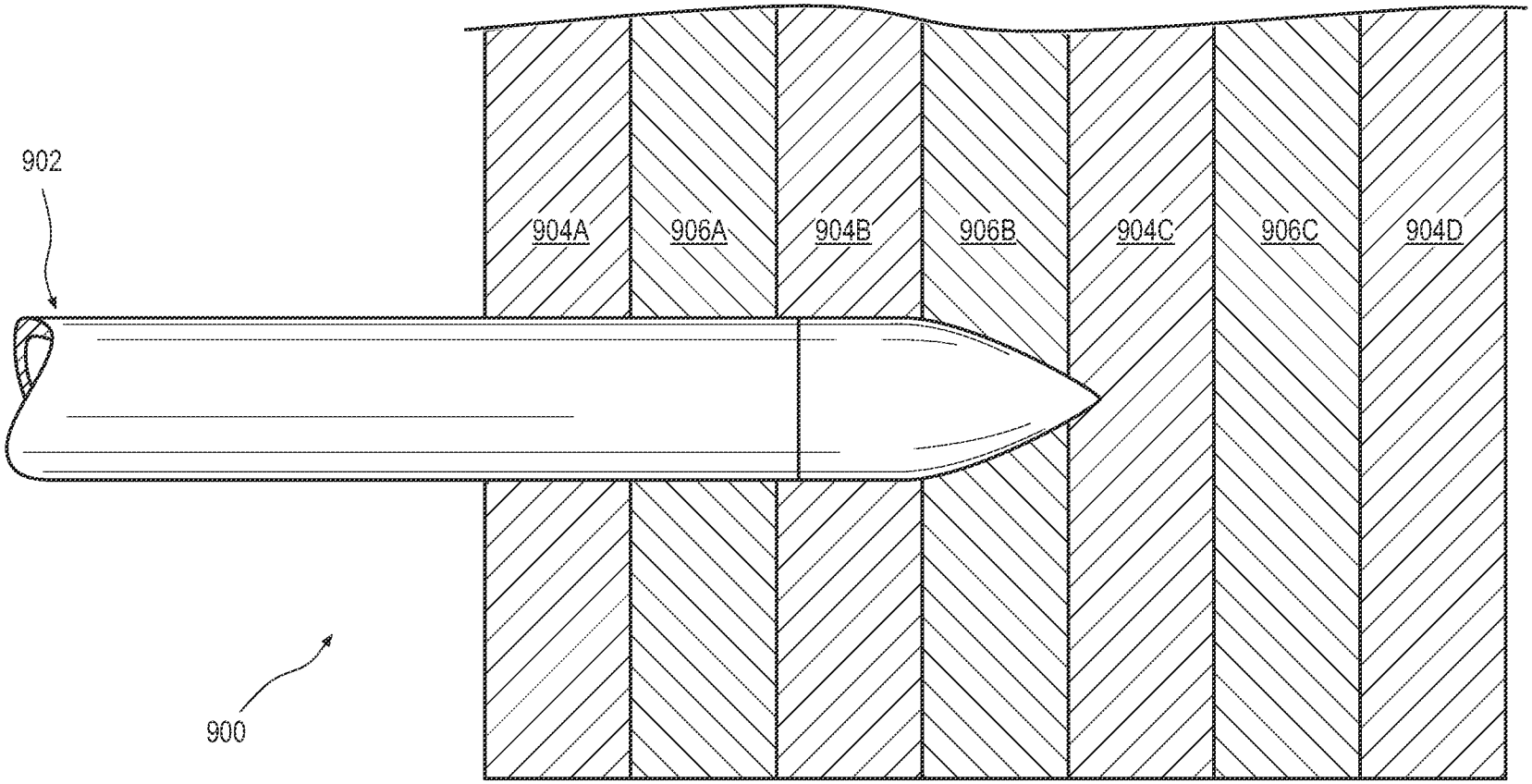
FIG. 9B is a cross-sectional detail view of an archery target and a projectile partially disposed within the archery target, according to some embodiments.

According to another aspect of the present disclosure, a NN material can be incorporated on or within an archery target to temporarily increase or decrease a viscosity of the archery target and thereby effect a depth a projectile can penetrate or transition into the archery target. FIG. 9A is a cross-sectional detail view of an archery target 900 and a projectile (e.g., arrow 902), according to some embodiments. The archery target 900 can include one or more layers including NN material 904A-D and one or more layers of conventional materials 906A-C used in archery targets. In some embodiments, the one or more layers including NN material 904A-D and the one or more layers of conventional materials 906A-C can form a repeating or alternating pattern. While the layers 904A-D and 906A-C are shown as extending generally parallel to the direction the arrow 902 penetrates the archery target 900, in other embodiments, as shown in FIG. 9B, the layers 904A-D and 906A-C can extend perpendicular to the direction the arrow 902 penetrates the archery target 900.

The layers of conventional materials 906A-C can be any material that can be used to form an archery target, such as, a polymer-based foam, plastics, cloth, or any other material. The one or more layers including NN material 904A-D can be any NN material capable of carrying out the principles and aspect disclosed herein. For example, a force applied by the arrow 902 onto the target 900 can cause the one or more portions of NN material's 904A-D viscosity to increase and thereby limit or reduce a depth the arrow 902 can penetrate into the archery target 900. Additionally, the NN material's 904A-D viscosity can be relatively lower when the arrow 902 has come to rest in the archery target 900 (i.e., a static state) such that removing the arrow 902 from the archery target 900 requires relatively less force. In other words, penetration of the arrow 902 into the archery target 900 can be reduced and the arrow 902 can be more easily pulled or removed from the archery target 900.

In some embodiments, the archery target 900 can include one or more additional layers, for example, the archery target 900 can include an external layer 908 defining an external face 910 of the archery target 900 (i.e., a surface that faces the archer while the archer is launching projectiles at the archery target 900). In some embodiments, the external layer 908 can extend perpendicular with respect to the one or more layers including NN material 904A-D (see FIG. 9A). Alternatively, the external layer 908 can extend parallel with respect to the one or more layers including NN material 904A-D (see FIG. 9B). The external layer 908 can at least partially cover one or more of the layers 904A-D and the layers 906A-C. The external layer 908 can be formed from a NN material, a Newtonian material, or a combination thereof.

While limbs, bowstrings, cables, projectiles, and archery targets incorporating NN material were each described in FIGS. 1-9B, these are just a few non-limiting examples of many different types of archery equipment, products, and components that can have NN material incorporated to improve performance. For example, a riser, a string stop, a stabilizer, a sight, a rest, a quiver, a grip, or any other archery bow component or archery product in general can incorporate one or more portions of NN material. Furthermore, changes can be made in the function and arrangement of archery components or products discussed without departing from the spirit and scope of the disclosure, and various embodiments can omit, substitute, or add other components or accessories as appropriate. For instance, one or more portions incorporated into a particular component described with respect to certain embodiments can be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow comprising:
a riser;
a first limb coupled to the riser;
a second limb coupled to the riser; and
a bowstring extending between the first limb and the second limb;
wherein at least one of the first limb or the second limb comprises a Non-Newtonian Material (NN material) coupled to an exterior surface of the first limb or the second limb, the NN material extending longitudinally across a portion of the exterior surface between opposing limb ends of the first limb or the second limb.

2. The archery bow of claim 1, wherein a viscosity of the NN material is configured to:
temporarily increase when a projectile is launched from the archery bow; or
temporarily decrease when a projectile is launched from the archery bow.

3. The archery bow of claim 1, wherein the exterior surface is a tensioned surface when the first limb or the second limb is loaded.

4. The archery bow of claim 1, wherein the first limb comprises a first portion of the NN material and the second limb comprises a second portion of the NN material.

5. The archery bow of claim 1, wherein the first limb defines a length and at least a portion of the NN material extends along a majority of the length.

6. The archery bow of claim 1, wherein additional NN material is coupled to a portion of a bowstring extending between the first limb and the second limb.

7. The archery bow of claim 1, wherein the NN material is comprises a polymer.

8. The archery bow of claim 1, wherein the archery bow is a compound bow or a recurve bow.

9. An archery bow comprising:
a riser;
a first limb coupled to the riser;
a second limb coupled to the riser; and
a bowstring extending between the first limb and the second limb;
wherein at least one of the first limb or the second limb comprises a Non-Newtonian Material (NN material) disposed between opposing exterior surfaces of the first limb or the second limb, the NN material forming an internal portion of the first limb or the second limb.

10. The archery bow of claim 9, wherein at least one of the first limb or the second limb comprises at least one internal layer of the NN material.

11. The archery bow of claim 10, wherein the at least one internal layer of the NN material is discontinuous along a length of the first limb or the second limb.

12. The archery bow of claim 9, wherein at least one of the first limb or the second limb comprises a first internal layer of the NN material positioned adjacent to a first exterior limb surface and a second internal layer of the NN material positioned adjacent to a second exterior limb surface opposite the first exterior limb surface.

* * * * *